US010236636B2

(12) United States Patent
Burris et al.

(10) Patent No.: US 10,236,636 B2
(45) Date of Patent: Mar. 19, 2019

(54) COAXIAL CABLE CONNECTOR WITH INTEGRAL RFI PROTECTION

(71) Applicant: Corning Optical Communications RF LLC, Glendale, AZ (US)

(72) Inventors: Donald Andrew Burris, Peoria, AZ (US); William Bernard Lutz, Glendale, AZ (US)

(73) Assignee: Corning Optical Communications RF LLC, Glendale, AZ (US)

( * ) Notice: Subject to any disclaimer, the term of this patent is extended or adjusted under 35 U.S.C. 154(b) by 0 days.

(21) Appl. No.: 15/874,306

(22) Filed: Jan. 18, 2018

(65) Prior Publication Data

US 2018/0145459 A1 May 24, 2018

Related U.S. Application Data

(63) Continuation of application No. 15/636,842, filed on Jun. 29, 2017, now Pat. No. 9,912,105, which is a (Continued)

(51) Int. Cl.
*H01R 9/05* (2006.01)
*H01R 13/6581* (2011.01)
(Continued)

(52) U.S. Cl.
CPC ..... *H01R 13/6581* (2013.01); *H01R 9/0524* (2013.01); *H01R 13/622* (2013.01); *H01R 24/40* (2013.01); *H01R 2103/00* (2013.01)

(58) Field of Classification Search
CPC .... H01R 13/6581; H01R 9/05; H01R 9/0524; H01R 13/6683; H01R 13/622; H01R 24/40
(Continued)

(56) References Cited

U.S. PATENT DOCUMENTS 331,169 A 11/1885 Thomas
346,958 A 8/1886 Stone
(Continued)

FOREIGN PATENT DOCUMENTS

CA 2096710 11/1994
CN 1210379 3/1999
(Continued)

OTHER PUBLICATIONS

International Search Report and Written Opinion of the International Searching Authority; PCT/US2013/064512; dated Jan. 21, 2014; 11 pages; European Patent Office.
(Continued)

*Primary Examiner* — Jean F Duverne
(74) *Attorney, Agent, or Firm* — Tamika A. Crawl-Bey

(57) ABSTRACT

A coaxial cable connector for coupling an end of a coaxial cable to a terminal is disclosed. The connector has a coupler adapted to couple the connector to a terminal, a body assembled with the coupler and a post assembled with the coupler and the body. The post is adapted to receive an end of a coaxial cable. The post has an integral contacting portion that is monolithic with at least a portion of the post. When assembled the coupler and post provide at least one circuitous path resulting in RF shielding such that RF signals external to the coaxial cable connector are attenuated, such that the integrity of an electrical signal transmitted through coaxial cable connector is maintained regardless of the tightness of the coupling of the connector to the terminal.

11 Claims, 19 Drawing Sheets

Related U.S. Application Data continuation of application No. 15/019,498, filed on Feb. 9, 2016, now Pat. No. 9,722,363, which is a continuation of application No. 13/653,095, filed on Oct. 16, 2012, now Pat. No. 9,287,659.

(51) Int. Cl.
*H01R 13/622* (2006.01)
*H01R 24/40* (2011.01)
*H01R 103/00* (2006.01)

(58) Field of Classification Search
USPC ..... 439/578
See application file for complete search history.

(56) References Cited

U.S. PATENT DOCUMENTS 459,951 A 9/1891 Warner
1,371,742 A 3/1921 Dringman
1,488,175 A 3/1924 Strandell
1,667,485 A 4/1928 MacDonald
1,766,869 A 6/1930 Austin
1,801,999 A 4/1931 Bowman
1,885,761 A 11/1932 Peirce, Jr.
1,959,302 A 5/1934 Paige
2,013,526 A 9/1935 Schmitt
2,059,920 A 11/1936 Weatherhead, Jr.
2,102,495 A 12/1937 England
2,258,528 A 10/1941 Wurzburger
2,258,737 A 10/1941 Browne
2,325,549 A 7/1943 Ryzowitz
2,480,963 A 9/1949 Quinn
2,544,654 A 3/1951 Brown
2,549,647 A 4/1951 Turenne
2,694,187 A 11/1954 Nash
2,705,652 A 4/1955 Kaiser
2,743,505 A 5/1956 Hill
2,754,487 A 7/1956 Carr et al.
2,755,331 A 7/1956 Melcher
2,757,351 A 7/1956 Klostermann
2,762,025 A 9/1956 Melcher
2,785,384 A 3/1957 Wickesser
2,805,399 A 9/1957 Leeper
2,816,949 A 12/1957 Curtiss
2,870,420 A 1/1959 Malek
2,878,039 A 3/1959 Hoegee et al.
2,881,406 A 4/1959 Arson
2,963,536 A 12/1960 Kokalas
3,001,169 A 9/1961 Blonder
3,015,794 A 1/1962 Kishbaugh
3,051,925 A 8/1962 Felts
3,091,748 A 5/1963 Takes et al.
3,094,364 A 6/1963 Lingg
3,103,548 A 9/1963 Concelman
3,106,548 A 10/1963 Lavalou
3,140,106 A 7/1964 Thomas et al.
3,161,451 A 12/1964 Neidecker
3,184,706 A 5/1965 Atkins
3,193,309 A 7/1965 Morris
3,194,292 A 7/1965 Borowsky
3,196,382 A 7/1965 Morello, Jr.
3,206,540 A 9/1965 Cohen
3,245,027 A 4/1966 Ziegler, Jr.
3,275,913 A 9/1966 Blanchard et al.
3,278,890 A 10/1966 Cooney
3,281,756 A 10/1966 O'Keefe et al.
3,281,757 A 10/1966 Bonhomme
3,290,069 A 12/1966 Davis
3,292,136 A 12/1966 Somerset
3,320,575 A 5/1967 Brown et al.
3,321,732 A 5/1967 Forney, Jr.
3,336,563 A 8/1967 Hyslop
3,348,186 A 10/1967 Rosen
3,350,667 A 10/1967 Shreve
3,350,677 A 10/1967 Daum
3,355,698 A 11/1967 Keller
3,372,364 A 3/1968 O'Keefe et al.
3,373,243 A 3/1968 Janowiak et al.
3,390,374 A 6/1968 Forney, Jr.
3,406,373 A 10/1968 Forney, Jr.
3,430,184 A 2/1969 Acord
3,448,430 A 6/1969 Kelly
3,453,376 A 7/1969 Ziegler, Jr. et al.
3,465,281 A 9/1969 Florer
3,475,545 A 10/1969 Stark et al.
3,494,400 A 2/1970 McCoy et al.
3,498,647 A 3/1970 Schroder
3,499,671 A 3/1970 Osborne
3,501,737 A 3/1970 Harris et al.
3,517,373 A 6/1970 Jamon
3,526,871 A 9/1970 Hobart
3,533,051 A 10/1970 Ziegler, Jr.
3,537,065 A 10/1970 Winston
3,544,705 A 12/1970 Winston
3,551,882 A 12/1970 O'Keefe
3,564,487 A 2/1971 Upstone et al.
3,587,033 A 6/1971 Brorein et al.
3,596,933 A 8/1971 Luckenbill
3,601,776 A 8/1971 Curl
3,603,912 A 9/1971 Kelly
3,614,711 A 10/1971 Anderson et al.
3,622,952 A 11/1971 Hilbert
3,629,792 A 12/1971 Dorrell
3,633,150 A 1/1972 Schwartz
3,646,502 A 2/1972 Hutter et al.
3,663,926 A 5/1972 Brandt
3,665,371 A 5/1972 Cripps
3,668,612 A 6/1972 Nepovim
3,669,472 A 6/1972 Nadsady
3,671,922 A 6/1972 Zerlin et al.
3,671,926 A 6/1972 Nepovim
3,678,444 A 7/1972 Stevens et al.
3,678,445 A 7/1972 Brancaloene
3,680,034 A 7/1972 Chow et al.
3,681,739 A 8/1972 Kornick
3,683,320 A 8/1972 Woods et al.
3,686,623 A 8/1972 Nijman
3,694,792 A 9/1972 Wallo
3,694,793 A 9/1972 Concelman
3,697,930 A 10/1972 Shirey
3,706,958 A 12/1972 Blanchenot
3,708,186 A 1/1973 Takagi et al.
3,710,005 A 1/1973 French
3,739,076 A 6/1973 Schwartz
3,744,007 A 7/1973 Horak
3,744,011 A 7/1973 Blanchenot
3,761,870 A 9/1973 Drezin et al.
3,778,535 A 12/1973 Forney, Jr.
3,781,762 A 12/1973 Quackenbush
3,781,898 A 12/1973 Holloway
3,783,178 A 1/1974 Philibert et al.
3,787,796 A 1/1974 Barr
3,793,610 A 2/1974 Brishka
3,798,589 A 3/1974 Deardurff
3,808,580 A 4/1974 Johnson
3,810,076 A 5/1974 Hutter
3,824,026 A 7/1974 Gaskins
3,835,443 A 9/1974 Arnold et al.
3,836,700 A 9/1974 Niemeyer
3,845,453 A 10/1974 Hemmer
3,846,738 A 11/1974 Nepovim
3,847,463 A 11/1974 Hayward et al.
3,854,003 A 12/1974 Duret
3,854,789 A 12/1974 Kaplan
3,858,156 A 12/1974 Zarro
3,879,102 A 4/1975 Horak
3,886,301 A 5/1975 Cronin et al.
3,907,335 A 9/1975 Burge et al.
3,907,399 A 9/1975 Spinner
3,910,673 A 10/1975 Stokes
3,915,539 A 10/1975 Collins
3,936,132 A 2/1976 Hutter
3,937,547 A 2/1976 Lee-Kemp
3,953,097 A 4/1976 Graham

(56) References Cited

U.S. PATENT DOCUMENTS 3,960,428 A 6/1976 Naus et al.
3,963,320 A 6/1976 Spinner
3,963,321 A 6/1976 Burger et al.
3,970,355 A 7/1976 Pitschi
3,972,013 A 7/1976 Shapiro
3,976,352 A 8/1976 Spinner
3,980,805 A 9/1976 Lipari
3,985,418 A 10/1976 Spinner
3,986,736 A 10/1976 Takagi et al.
4,012,105 A 3/1977 Biddle
4,017,139 A 4/1977 Nelson
4,022,966 A 5/1977 Gajajiva
4,030,742 A 6/1977 Eidelberg et al.
4,030,798 A 6/1977 Paoli
4,032,177 A 6/1977 Anderson
4,045,706 A 8/1977 Daffner et al.
4,046,451 A 9/1977 Juds et al.
4,053,200 A 10/1977 Pugner
4,056,043 A 11/1977 Sriramamurty et al.
4,059,330 A 11/1977 Shirey
4,079,343 A 3/1978 Nijman
4,082,404 A 4/1978 Flatt
4,090,028 A 5/1978 Vontobel
4,093,335 A 6/1978 Schwartz et al.
4,100,943 A 7/1978 Terada et al.
4,106,839 A 8/1978 Cooper
4,109,126 A 8/1978 Halbeck
4,118,097 A 10/1978 Budnick
4,125,308 A 11/1978 Schilling
4,126,372 A 11/1978 Hashimoto et al.
4,131,332 A 12/1978 Hogendobler et al.
4,136,897 A 1/1979 Haluch
4,150,250 A 4/1979 Lundeberg
4,153,320 A 5/1979 Townshend
4,156,554 A 5/1979 Aujla
4,165,911 A 8/1979 Laudig
4,168,921 A 9/1979 Blanchard
4,169,646 A 10/1979 Stape et al.
4,173,385 A 11/1979 Fenn et al.
4,174,875 A 11/1979 Wilson et al.
4,187,481 A 2/1980 Bourtos
4,193,655 A 3/1980 Herrmann, Jr.
4,194,338 A 3/1980 Trafton
4,197,628 A 4/1980 Conti et al.
4,206,963 A 6/1980 English et al.
4,212,487 A 7/1980 Jones et al.
4,225,162 A 9/1980 Dola
4,227,765 A 10/1980 Neumann et al.
4,229,714 A 10/1980 Yu
4,239,318 A 12/1980 Schwartz
4,250,348 A 2/1981 Kitagawa
4,260,212 A 4/1981 Ritchie
4,273,405 A 6/1981 Law
4,280,749 A 7/1981 Hemmer
4,285,564 A 8/1981 Spinner
4,290,663 A 9/1981 Fowler et al.
4,296,986 A 10/1981 Herrmann, Jr.
4,307,926 A 12/1981 Smith
4,309,050 A 1/1982 Legris
4,310,211 A 1/1982 Bunnell et al.
4,322,121 A 3/1982 Riches et al.
4,326,768 A 4/1982 Punako
4,326,769 A 4/1982 Dorsey et al.
4,334,730 A 6/1982 Colwell et al.
4,339,166 A 7/1982 Dayton
4,345,375 A 8/1982 Hayward
4,346,958 A 8/1982 Blanchard
4,354,721 A 10/1982 Luzzi
4,358,174 A 11/1982 Dreyer
4,373,767 A 2/1983 Cairns
4,389,081 A 6/1983 Gallusser et al.
4,400,050 A 8/1983 Hayward
4,407,529 A 10/1983 Holman
4,408,821 A 10/1983 Forney, Jr.
4,408,822 A 10/1983 Nikitas
4,412,717 A 11/1983 Monroe
4,421,377 A 12/1983 Spinner
4,426,127 A 1/1984 Kubota
4,428,639 A 1/1984 Hillis
4,444,453 A 4/1984 Kirby et al.
4,447,107 A 5/1984 Major et al.
4,452,503 A 6/1984 Forney, Jr.
4,453,200 A 6/1984 Trcka et al.
4,456,323 A 6/1984 Pitcher et al.
4,459,881 A 7/1984 Hughes, Jr.
4,462,653 A 7/1984 Flederbach et al.
4,464,000 A 8/1984 Werth et al.
4,464,001 A 8/1984 Collins
4,469,386 A 9/1984 Ackerman
4,470,657 A 9/1984 Deacon
4,477,132 A 10/1984 Moser et al.
4,484,792 A 11/1984 Tengler et al.
4,484,796 A 11/1984 Sato et al.
4,490,576 A 12/1984 Bolante et al.
4,491,685 A 1/1985 Drew et al.
4,506,943 A 3/1985 Drogo
4,515,427 A 5/1985 Smit
4,525,017 A 6/1985 Schildkraut et al.
4,531,790 A 7/1985 Selvin
4,531,805 A 7/1985 Werth
4,533,191 A 8/1985 Blackwood
4,540,231 A 9/1985 Forney, Jr.
RE31,995 E 10/1985 Ball
4,545,633 A 10/1985 McGeary
4,545,637 A 10/1985 Bosshard et al.
4,553,877 A 11/1985 Edvardsen
4,575,274 A 3/1986 Hayward
4,580,862 A 4/1986 Johnson
4,580,865 A 4/1986 Fryberger
4,583,811 A 4/1986 McMills
4,585,289 A 4/1986 Bocher
589,216 A 5/1986 McKee
4,588,246 A 5/1986 Schildkraut et al.
4,593,964 A 6/1986 Forney, Jr. et al.
4,596,434 A 6/1986 Saba et al.
4,596,435 A 6/1986 Bickford
4,597,621 A 7/1986 Burns
4,598,959 A 7/1986 Selvin
4,598,961 A 7/1986 Cohen
4,600,263 A 7/1986 DeChamp et al.
4,613,199 A 9/1986 McGeary
4,614,390 A 9/1986 Baker
4,616,900 A 10/1986 Cairns
4,623,205 A 11/1986 Barron
4,632,487 A 12/1986 Wargula
4,634,213 A 1/1987 Larsson et al.
4,640,572 A 2/1987 Conlon
4,645,281 A 2/1987 Burger
4,647,135 A 3/1987 Reinhardt
4,650,228 A 3/1987 McMills et al.
4,655,159 A 4/1987 McMills
4,655,534 A 4/1987 Stursa
4,660,921 A 4/1987 Hauver
4,666,190 A 5/1987 Yamabe et al.
4,666,231 A 5/1987 Sheesley et al.
4,668,043 A 5/1987 Saba et al.
4,670,574 A 6/1987 Malcolm
4,673,236 A 6/1987 Musolff et al.
4,674,809 A 6/1987 Hollyday et al.
4,674,818 A 6/1987 McMills et al.
4,676,577 A 6/1987 Szegda
4,682,832 A 7/1987 Punako et al.
4,684,201 A 8/1987 Hutter
4,688,876 A 8/1987 Morelli
4,688,878 A 8/1987 Cohen et al.
4,690,482 A 9/1987 Chamberland et al.
4,691,976 A 9/1987 Cowen
4,703,987 A 11/1987 Gullusser et al.
4,703,988 A 11/1987 Raux et al.
4,713,021 A 12/1987 Kobler
4,717,355 A 1/1988 Mattis
4,720,155 A 1/1988 Schildkraut et al.
4,728,301 A 3/1988 Hemmer et al.
4,734,050 A 3/1988 Negre et al.

(56) References Cited

U.S. PATENT DOCUMENTS

| | | | |
|---|---|---|---|
| 4,734,666 | A | 3/1988 | Ohya et al. |
| 4,737,123 | A | 4/1988 | Paler et al. |
| 4,738,009 | A | 4/1988 | Down et al. |
| 4,738,628 | A | 4/1988 | Rees |
| 4,739,009 | A | 4/1988 | Down et al. |
| 4,739,126 | A | 4/1988 | Gutter et al. |
| 4,746,305 | A | 5/1988 | Nomura |
| 4,747,656 | A | 5/1988 | Miyahara et al. |
| 4,747,786 | A | 5/1988 | Hayashi et al. |
| 4,749,821 | A | 6/1988 | Linton et al. |
| 4,755,152 | A | 7/1988 | Elliot et al. |
| 4,757,274 | A | 7/1988 | Bowers |
| 4,757,297 | A | 7/1988 | Frawley |
| 4,759,729 | A | 7/1988 | Kemppainen et al. |
| 4,761,146 | A | 8/1988 | Sohoel |
| 4,772,222 | A | 9/1988 | Laudig et al. |
| 4,789,355 | A | 12/1988 | Lee |
| 4,789,759 | A | 12/1988 | Jones |
| 4,795,360 | A | 1/1989 | Newman et al. |
| 4,797,120 | A | 1/1989 | Ulery |
| 4,806,116 | A | 2/1989 | Ackerman |
| 4,807,891 | A | 2/1989 | Neher |
| 4,808,128 | A | 2/1989 | Werth |
| 4,810,017 | A | 3/1989 | Knak et al. |
| 4,813,886 | A | 3/1989 | Roos et al. |
| 4,820,185 | A | 4/1989 | Moulin |
| 4,834,675 | A | 5/1989 | Samchisen |
| 4,834,676 | A | 5/1989 | Tackett |
| 4,835,342 | A | 5/1989 | Guginsky |
| 4,836,580 | A | 6/1989 | Farrell |
| 4,836,801 | A | 6/1989 | Ramirez |
| 4,838,813 | A | 6/1989 | Pauza et al. |
| 4,846,731 | A | 7/1989 | Alwine |
| 4,854,893 | A | 8/1989 | Morris |
| 4,857,014 | A | 8/1989 | Alf et al. |
| 4,867,489 | A | 9/1989 | Patel |
| 4,867,706 | A | 9/1989 | Tang |
| 4,869,679 | A | 9/1989 | Szegda |
| 4,874,331 | A | 10/1989 | Iverson |
| 4,881,912 | A | 11/1989 | Thommen et al. |
| 4,892,275 | A | 1/1990 | Szegda |
| 4,902,246 | A | 2/1990 | Samchisen |
| 4,906,207 | A | 3/1990 | Banning et al. |
| 4,915,651 | A | 4/1990 | Bout |
| 4,921,447 | A | 5/1990 | Capp et al. |
| 4,923,412 | A | 5/1990 | Morris |
| 4,925,403 | A | 5/1990 | Zorzy |
| 4,927,385 | A | 5/1990 | Cheng |
| 4,929,188 | A | 5/1990 | Lionetto et al. |
| 4,934,960 | A | 6/1990 | Capp et al. |
| 4,938,718 | A | 7/1990 | Guendel |
| 4,941,846 | A | 7/1990 | Guimond et al. |
| 4,952,174 | A | 8/1990 | Sucht et al. |
| 4,957,456 | A | 9/1990 | Olson et al. |
| 4,963,105 | A | 10/1990 | Lewis et al. |
| 4,964,805 | A | 10/1990 | Gabany |
| 4,964,812 | A | 10/1990 | Siemon et al. |
| 4,973,265 | A | 11/1990 | Heeren |
| 4,976,632 | A | 12/1990 | Riches |
| 4,979,911 | A | 12/1990 | Spencer |
| 4,990,104 | A | 2/1991 | Schieferly |
| 4,990,105 | A | 2/1991 | Karlovich |
| 4,990,106 | A | 2/1991 | Szegda |
| 4,992,061 | A | 2/1991 | Brush, Jr. |
| 5,002,503 | A | 3/1991 | Campbell et al. |
| 5,007,861 | A | 4/1991 | Stirling |
| 5,011,422 | A | 4/1991 | Yeh |
| 5,011,432 | A | 4/1991 | Sucht et al. |
| 5,018,822 | A | 5/1991 | Freismuth et al. |
| 5,021,010 | A | 6/1991 | Wright |
| 5,024,606 | A | 6/1991 | Ming-Hwa |
| 5,030,126 | A | 7/1991 | Hanlon |
| 5,037,328 | A | 8/1991 | Karlovich |
| 5,046,964 | A | 9/1991 | Welsh et al. |
| 5,052,947 | A | 10/1991 | Brodie et al. |
| 5,055,060 | A | 10/1991 | Down et al. |
| 5,059,139 | A | 10/1991 | Spinner |
| 5,059,747 | A | 10/1991 | Bawa et al. |
| 5,062,804 | A | 11/1991 | Jamet et al. |
| 5,066,248 | A | 11/1991 | Gaver, Jr. et al. |
| 5,067,912 | A | 11/1991 | Bickford et al. |
| 5,073,129 | A | 12/1991 | Szegda |
| 5,074,809 | A | 12/1991 | Rousseau et al. |
| 5,080,600 | A | 1/1992 | Baker et al. |
| 5,083,943 | A | 1/1992 | Tarrant |
| 5,088,937 | A | 2/1992 | Gabany |
| 5,120,260 | A | 6/1992 | Jackson |
| 5,127,853 | A | 7/1992 | McMills et al. |
| 5,131,862 | A | 7/1992 | Gershfeld |
| 5,137,470 | A | 8/1992 | Doles |
| 5,137,471 | A | 8/1992 | Verespej et al. |
| 5,139,440 | A | 8/1992 | Volk et al. |
| 5,141,448 | A | 8/1992 | Mattingly et al. |
| 5,141,451 | A | 8/1992 | Down |
| 5,149,274 | A | 9/1992 | Gallusser et al. |
| 5,150,924 | A | 9/1992 | Yokomatsu et al. |
| 5,154,636 | A | 10/1992 | Vaccaro et al. |
| 5,161,993 | A | 11/1992 | Leibfried, Jr. |
| 5,166,477 | A | 11/1992 | Perin, Jr. et al. |
| 5,167,545 | A | 12/1992 | O'Brien et al. |
| 5,169,323 | A | 12/1992 | Kawai et al. |
| 5,176,530 | A | 1/1993 | Reylek |
| 5,176,533 | A | 1/1993 | Sakurai et al. |
| 5,181,161 | A | 1/1993 | Hirose et al. |
| 5,183,417 | A | 2/1993 | Bools |
| 5,185,655 | A | 2/1993 | Glenday et al. |
| 5,186,501 | A | 2/1993 | Mano |
| 5,186,655 | A | 2/1993 | Glenday et al. |
| 5,195,904 | A | 3/1993 | Cyvoct |
| 5,195,905 | A | 3/1993 | Pesci |
| 5,195,906 | A | 3/1993 | Szegda |
| 5,205,547 | A | 4/1993 | Mattingly |
| 5,205,761 | A | 4/1993 | Nilsson |
| D335,487 | S | 5/1993 | Volk et al. |
| 5,207,602 | A | 5/1993 | McMills et al. |
| 5,215,477 | A | 6/1993 | Weber et al. |
| 5,217,391 | A | 6/1993 | Fisher, Jr. |
| 5,217,392 | A | 6/1993 | Hosler, Sr. |
| 5,217,393 | A | 6/1993 | Del Negro et al. |
| 5,221,216 | A | 6/1993 | Gabany et al. |
| 5,227,587 | A | 7/1993 | Paterek |
| 5,247,424 | A | 9/1993 | Harris et al. |
| 5,263,880 | A | 11/1993 | Schwarz et al. |
| 5,269,701 | A | 12/1993 | Leibfried, Jr. |
| 5,281,762 | A | 1/1994 | Long et al. |
| 5,283,417 | A | 2/1994 | Misawa et al. |
| 5,283,853 | A | 2/1994 | Szegda |
| 5,284,449 | A | 2/1994 | Vaccaro |
| 5,294,864 | A | 3/1994 | Do |
| 5,295,864 | A | 3/1994 | Birch et al. |
| 5,316,348 | A | 5/1994 | Franklin |
| 5,316,494 | A | 5/1994 | Flanagan et al. |
| 5,318,459 | A | 6/1994 | Sheilds |
| 5,321,205 | A | 6/1994 | Bawa et al. |
| 5,334,032 | A | 8/1994 | Myers et al. |
| 5,334,051 | A | 8/1994 | Devine et al. |
| 5,338,225 | A | 8/1994 | Jacobsen et al. |
| 5,342,218 | A | 8/1994 | McMills et al. |
| 5,352,134 | A | 10/1994 | Jacobsen et al. |
| 5,354,217 | A | 10/1994 | Gabel et al. |
| 5,362,250 | A | 11/1994 | McMills et al. |
| 5,362,251 | A | 11/1994 | Bielak |
| 5,366,260 | A | 11/1994 | Wartluft |
| 5,371,819 | A | 12/1994 | Szegda |
| 5,371,821 | A | 12/1994 | Szegda |
| 5,371,827 | A | 12/1994 | Szegda |
| 5,380,211 | A | 1/1995 | Kawagauchi et al. |
| 5,389,005 | A | 2/1995 | Kodama |
| 5,393,244 | A | 2/1995 | Szegda |
| 5,397,252 | A | 3/1995 | Wang |
| 5,413,504 | A | 5/1995 | Kloecker et al. |
| 5,431,583 | A | 7/1995 | Szegda |
| 5,435,745 | A | 7/1995 | Booth |
| 5,435,751 | A | 7/1995 | Papenheim et al. |

(56) References Cited

U.S. PATENT DOCUMENTS

| | | | |
|---|---|---|---|
| 5,435,760 | A | 7/1995 | Miklos |
| 5,439,386 | A | 8/1995 | Ellis et al. |
| 5,444,810 | A | 8/1995 | Szegda |
| 5,455,548 | A | 10/1995 | Grandchamp et al. |
| 5,456,611 | A | 10/1995 | Henry et al. |
| 5,456,614 | A | 10/1995 | Szegda |
| 5,466,173 | A | 11/1995 | Down |
| 5,470,257 | A | 11/1995 | Szegda |
| 5,474,478 | A | 12/1995 | Ballog |
| 5,475,921 | A | 12/1995 | Johnston |
| 5,488,268 | A | 1/1996 | Bauer et al. |
| 5,490,033 | A | 2/1996 | Cronin |
| 5,490,801 | A | 2/1996 | Fisher, Jr. et al. |
| 5,494,454 | A | 2/1996 | Johnsen |
| 5,499,934 | A | 3/1996 | Jacobsen et al. |
| 5,501,616 | A | 3/1996 | Holliday |
| 5,511,305 | A | 4/1996 | Garner |
| 5,516,303 | A | 5/1996 | Yohn et al. |
| 5,525,076 | A | 6/1996 | Down |
| 5,542,861 | A | 8/1996 | Anhalt et al. |
| 5,548,088 | A | 8/1996 | Gray et al. |
| 5,550,521 | A | 8/1996 | Bernaud et al. |
| 5,564,938 | A | 10/1996 | Shenkal et al. |
| 5,566,173 | A | 10/1996 | Steinbrecher |
| 5,571,028 | A | 11/1996 | Szegda |
| 5,571,029 | A | 11/1996 | Poissant et al. |
| 5,586,910 | A | 12/1996 | Del Negro et al. |
| 5,595,499 | A | 1/1997 | Zander et al. |
| 5,598,132 | A | 1/1997 | Stabile |
| 5,607,320 | A | 3/1997 | Wright |
| 5,607,325 | A | 3/1997 | Toma |
| 5,609,501 | A | 3/1997 | McMills et al. |
| 5,620,339 | A | 4/1997 | Gray et al. |
| 5,632,637 | A | 5/1997 | Diener |
| 5,632,651 | A | 5/1997 | Szegda |
| 5,644,104 | A | 7/1997 | Porter et al. |
| 5,649,723 | A | 7/1997 | Larsson |
| 5,651,698 | A | 7/1997 | Locati et al. |
| 5,651,699 | A | 7/1997 | Holliday |
| 5,653,605 | A | 8/1997 | Woehl et al. |
| 5,667,405 | A | 9/1997 | Holliday |
| 5,681,172 | A | 10/1997 | Moldenhauer |
| 5,683,263 | A | 11/1997 | Hsu |
| 5,702,263 | A | 12/1997 | Baumann et al. |
| 5,722,856 | A | 3/1998 | Fuchs et al. |
| 5,735,704 | A | 4/1998 | Anthony |
| 5,743,131 | A | 4/1998 | Holliday et al. |
| 5,746,617 | A | 5/1998 | Porter, Jr. et al. |
| 5,746,619 | A | 5/1998 | Harting et al. |
| 5,759,618 | A | 6/1998 | Taylor |
| 5,761,053 | A | 6/1998 | King et al. |
| 5,769,652 | A | 6/1998 | Wider |
| 5,769,662 | A | 6/1998 | Stabile et al. |
| 5,774,344 | A | 6/1998 | Casebolt |
| 5,775,927 | A | 7/1998 | Wider |
| 5,788,289 | A | 8/1998 | Cronley |
| 5,791,698 | A | 8/1998 | Wartluft et al. |
| 5,797,633 | A | 8/1998 | Katzer et al. |
| 5,817,978 | A | 10/1998 | Hermant et al. |
| 5,863,220 | A | 1/1999 | Holliday |
| 5,874,603 | A | 2/1999 | Arkles |
| 5,877,452 | A | 3/1999 | McConnell |
| 5,879,191 | A | 3/1999 | Burris |
| 5,882,226 | A | 3/1999 | Bell et al. |
| 5,890,924 | A | 4/1999 | Endo |
| 5,897,795 | A | 4/1999 | Lu et al. |
| 5,906,511 | A | 5/1999 | Bozzer et al. |
| 5,917,153 | A | 6/1999 | Geroldinger |
| 5,921,793 | A | 7/1999 | Phillips |
| 5,929,383 | A | 7/1999 | Marik et al. |
| 5,938,465 | A | 8/1999 | Fox, Sr. |
| 5,944,548 | A | 8/1999 | Saito |
| 5,951,327 | A | 9/1999 | Marik |
| 5,954,708 | A | 9/1999 | Lopez et al. |
| 5,957,716 | A | 9/1999 | Buckley et al. |
| 5,967,852 | A | 10/1999 | Follingstad et al. |
| 5,975,479 | A | 11/1999 | Suter |
| 5,975,591 | A | 11/1999 | Guest |
| 5,975,949 | A | 11/1999 | Holliday et al. |
| 5,975,951 | A | 11/1999 | Burris et al. |
| 5,977,841 | A | 11/1999 | Lee et al. |
| 5,997,350 | A | 12/1999 | Burris et al. |
| 6,010,349 | A | 1/2000 | Porter, Jr. |
| 6,019,635 | A | 2/2000 | Nelson |
| 6,022,237 | A | 2/2000 | Esh |
| 6,032,358 | A | 3/2000 | Wild |
| 6,036,540 | A | 3/2000 | Beloritsky |
| 6,042,422 | A | 3/2000 | Youtsey |
| 6,042,429 | A | 3/2000 | Bianca et al. |
| 6,048,229 | A | 4/2000 | Lazaro, Jr. |
| 6,053,743 | A | 4/2000 | Mitchell et al. |
| 6,053,769 | A | 4/2000 | Kubota et al. |
| 6,053,777 | A | 4/2000 | Boyle |
| 6,062,607 | A | 5/2000 | Barthlomew |
| 6,080,015 | A | 6/2000 | Andreescu |
| 6,083,030 | A | 7/2000 | Wright |
| 6,083,053 | A | 7/2000 | Anderson, Jr. et al. |
| 6,089,903 | A | 7/2000 | Stafford Gray et al. |
| 6,089,912 | A | 7/2000 | Tallis et al. |
| 6,089,913 | A | 7/2000 | Holliday |
| 6,093,043 | A | 7/2000 | Gray et al. |
| 6,095,828 | A | 8/2000 | Burland |
| 6,095,841 | A | 8/2000 | Felps |
| 6,123,550 | A | 9/2000 | Burkert et al. |
| 6,123,567 | A | 9/2000 | McCarthy |
| 6,126,487 | A | 10/2000 | Rosenberger et al. |
| 6,132,234 | A | 10/2000 | Waidner et al. |
| 6,142,812 | A | 11/2000 | Hwang |
| 6,146,197 | A | 11/2000 | Holliday et al. |
| 6,152,752 | A | 11/2000 | Fukuda |
| 6,152,753 | A | 11/2000 | Johnson et al. |
| 6,153,830 | A | 11/2000 | Montena |
| 6,158,298 | A | 12/2000 | Hara |
| 6,162,995 | A | 12/2000 | Bachle et al. |
| 6,164,977 | A | 12/2000 | Lester |
| 6,174,206 | B1 | 1/2001 | Yentile et al. |
| 6,183,298 | B1 | 2/2001 | Henningsen |
| 6,199,913 | B1 | 3/2001 | Wang |
| 6,199,920 | B1 | 3/2001 | Neustadtl |
| 6,210,216 | B1 | 4/2001 | Tso-Chin et al. |
| 6,210,219 | B1 | 4/2001 | Zhu et al. |
| 6,210,222 | B1 | 4/2001 | Langham et al. |
| 6,217,383 | B1 | 4/2001 | Holland et al. |
| 6,238,240 | B1 | 5/2001 | Yu |
| 6,239,359 | B1 | 5/2001 | Lilienthal, II et al. |
| 6,241,553 | B1 | 6/2001 | Hsia |
| 6,250,942 | B1 | 6/2001 | Lemke et al. |
| 6,250,974 | B1 | 6/2001 | Kerek |
| 6,257,923 | B1 | 7/2001 | Stone et al. |
| 6,261,126 | B1 | 7/2001 | Stirling |
| 6,267,612 | B1 | 7/2001 | Areykiewicz et al. |
| 6,271,464 | B1 | 8/2001 | Cunningham |
| 6,299,475 | B1 | 10/2001 | Huspeni et al. |
| 6,331,123 | B1 | 12/2001 | Rodrigues |
| 6,332,815 | B1 | 12/2001 | Bruce |
| 6,352,448 | B1 | 3/2002 | Holliday et al. |
| 6,358,077 | B1 | 3/2002 | Young |
| 6,361,348 | B1 | 3/2002 | Hall et al. |
| 6,361,364 | B1 | 3/2002 | Holland et al. |
| 6,375,509 | B2 | 4/2002 | Mountford |
| 6,379,183 | B1 | 4/2002 | Ayres et al. |
| 6,394,840 | B1 | 5/2002 | Gassauer et al. |
| 6,396,367 | B1 | 5/2002 | Rosenberger |
| D458,904 | S | 6/2002 | Montena |
| 6,398,571 | B1 | 6/2002 | Nishide et al. |
| 6,406,330 | B2 | 6/2002 | Bruce |
| 6,409,534 | B1 | 6/2002 | Weisz-Margulescu |
| D460,739 | S | 7/2002 | Fox |
| D460,740 | S | 7/2002 | Montena |
| D460,946 | S | 7/2002 | Montena |
| D460,947 | S | 7/2002 | Montena |
| D460,948 | S | 7/2002 | Montena |
| 6,422,884 | B1 | 7/2002 | Babasick et al. |
| 6,422,900 | B1 | 7/2002 | Hogan |

(56) References Cited

U.S. PATENT DOCUMENTS

| | | | |
|---|---|---|---|
| 6,425,782 | B1 | 7/2002 | Holland |
| D461,166 | S | 8/2002 | Montena |
| D461,167 | S | 8/2002 | Montena |
| D461,778 | S | 8/2002 | Fox |
| D462,058 | S | 8/2002 | Montena |
| D462,060 | S | 8/2002 | Fox |
| 6,439,899 | B1 | 8/2002 | Muzslay et al. |
| D462,327 | S | 9/2002 | Montena |
| 6,443,763 | B1 | 9/2002 | Richet |
| 6,450,829 | B1 | 9/2002 | Weisz-Margulescu |
| 6,454,463 | B1 | 9/2002 | Halbach |
| 6,464,526 | B1 | 10/2002 | Seufert et al. |
| 6,464,527 | B2 | 10/2002 | Volpe et al. |
| 6,467,816 | B1 | 10/2002 | Huang |
| 6,468,100 | B1 | 10/2002 | Meyer et al. |
| 6,468,103 | B1 | 10/2002 | Brower |
| 6,491,546 | B1 | 12/2002 | Perry |
| D468,696 | S | 1/2003 | Montena |
| 6,506,083 | B1 | 1/2003 | Bickford et al. |
| 6,510,610 | B2 | 1/2003 | Losinger |
| 6,520,800 | B1 | 2/2003 | Michelbach et al. |
| 6,530,807 | B2 | 3/2003 | Rodrigues et al. |
| 6,540,531 | B2 | 4/2003 | Syed et al. |
| 6,558,194 | B2 | 5/2003 | Montena |
| 6,572,419 | B2 | 6/2003 | Feye-Homann |
| 6,576,833 | B2 | 6/2003 | Covaro et al. |
| 6,619,876 | B2 | 9/2003 | Vaitkus et al. |
| 6,632,104 | B2 | 10/2003 | Quadir |
| 6,634,906 | B1 | 10/2003 | Yeh |
| 6,637,101 | B2 | 10/2003 | Hathaway et al. |
| 6,645,011 | B2 | 11/2003 | Schneider et al. |
| 6,663,397 | B1 | 12/2003 | Lin et al. |
| 6,676,446 | B2 | 1/2004 | Montena |
| 6,683,253 | B1 | 1/2004 | Lee |
| 6,683,773 | B2 | 1/2004 | Montena |
| 6,692,285 | B2 | 2/2004 | Islam |
| 6,692,286 | B1 | 2/2004 | De Cet |
| 6,695,636 | B2 | 2/2004 | Hall et al. |
| 6,705,875 | B2 | 3/2004 | Berghorn et al. |
| 6,705,884 | B1 | 3/2004 | McCarthy |
| 6,709,280 | B1 | 3/2004 | Gretz |
| 6,709,289 | B2 | 3/2004 | Huber et al. |
| 6,712,631 | B1 | 3/2004 | Youtsey |
| 6,716,041 | B2 | 4/2004 | Ferderer et al. |
| 6,716,062 | B1 | 4/2004 | Palinkas et al. |
| 6,733,336 | B1 | 5/2004 | Montena et al. |
| 6,733,337 | B2 | 5/2004 | Kodaira |
| 6,743,040 | B1 | 6/2004 | Nakamura |
| 6,749,454 | B2 | 6/2004 | Schmidt et al. |
| 6,751,081 | B1 | 6/2004 | Kooiman |
| 6,752,633 | B2 | 6/2004 | Aizawa et al. |
| 6,761,571 | B2 | 7/2004 | Hida |
| 6,767,248 | B1 | 7/2004 | Hung |
| 6,769,926 | B1 | 8/2004 | Montena |
| 6,780,029 | B1 | 8/2004 | Gretz |
| 6,780,042 | B1 | 8/2004 | Badescu et al. |
| 6,780,052 | B2 | 8/2004 | Montena et al. |
| 6,780,068 | B2 | 8/2004 | Bartholoma et al. |
| 6,783,394 | B1 | 8/2004 | Holliday |
| 6,690,081 | B2 | 9/2004 | Burris et al. |
| 6,786,767 | B1 | 9/2004 | Fuks et al. |
| 6,790,081 | B2 | 9/2004 | Burris et al. |
| 6,793,528 | B2 | 9/2004 | Lin et al. |
| 6,796,847 | B2 | 9/2004 | AbuGhezaleh |
| 6,802,738 | B1 | 10/2004 | Henningsen |
| 6,805,581 | B2 | 10/2004 | Chen |
| 6,805,583 | B2 | 10/2004 | Holliday et al. |
| 6,805,584 | B1 | 10/2004 | Chen |
| 6,808,415 | B1 | 10/2004 | Montena |
| 6,817,272 | B2 | 11/2004 | Holland |
| 6,817,896 | B2 | 11/2004 | Derenthal |
| 6,817,897 | B2 | 11/2004 | Chee |
| 6,827,608 | B2 | 12/2004 | Hall et al. |
| 6,830,479 | B2 | 12/2004 | Holliday |
| 6,848,115 | B2 | 1/2005 | Sugiura et al. |
| 6,848,939 | B2 | 2/2005 | Stirling |
| 6,848,940 | B2 | 2/2005 | Montena |
| 6,848,941 | B2 | 2/2005 | Wlos et al. |
| 6,884,113 | B1 | 4/2005 | Montena |
| 6,884,115 | B2 | 4/2005 | Malloy |
| 6,887,102 | B1 | 5/2005 | Burris et al. |
| 6,916,200 | B2 | 7/2005 | Burris et al. |
| 6,929,265 | B2 | 8/2005 | Holland et al. |
| 6,929,508 | B1 | 8/2005 | Holland |
| 6,935,866 | B2 | 8/2005 | Kerekes et al. |
| 6,939,169 | B2 | 9/2005 | Islam et al. |
| 6,942,516 | B2 | 9/2005 | Shimoyama et al. |
| 6,942,520 | B2 | 9/2005 | Barlian et al. |
| 6,944,005 | B2 | 9/2005 | Kooiman |
| 6,945,805 | B1 | 9/2005 | Bollinger |
| 6,948,976 | B2 | 9/2005 | Goodwin et al. |
| 6,953,371 | B2 | 10/2005 | Baker et al. |
| 6,955,563 | B1 | 10/2005 | Croan |
| D511,497 | S | 11/2005 | Murphy et al. |
| D512,024 | S | 11/2005 | Murphy et al. |
| D512,689 | S | 12/2005 | Murphy et al. |
| 6,971,912 | B2 | 12/2005 | Montena et al. |
| 6,979,234 | B2 | 12/2005 | Bleicher |
| 7,008,263 | B2 | 3/2006 | Holland |
| 7,018,216 | B1 | 3/2006 | Clark et al. |
| 7,018,235 | B1 | 3/2006 | Burris et al. |
| 7,029,326 | B2 | 4/2006 | Montena |
| D521,454 | S | 5/2006 | Murphy et al. |
| 7,062,851 | B2 | 6/2006 | Koessler |
| 7,063,565 | B2 | 6/2006 | Ward |
| 7,070,447 | B1 | 7/2006 | Montena |
| 7,077,697 | B2 | 7/2006 | Kooiman |
| 7,077,699 | B2 | 7/2006 | Islam et al. |
| 7,086,897 | B2 | 8/2006 | Montena |
| 7,090,525 | B1 | 8/2006 | Morana |
| 7,094,114 | B2 | 8/2006 | Kurimoto |
| 7,097,499 | B1 | 8/2006 | Purdy |
| 7,102,868 | B2 | 9/2006 | Montena |
| 7,108,547 | B2 | 9/2006 | Kisling et al. |
| 7,108,548 | B2 | 9/2006 | Burris et al. |
| 7,112,078 | B2 | 9/2006 | Czikora |
| 7,112,093 | B1 | 9/2006 | Holland |
| 7,114,990 | B2 | 10/2006 | Bence et al. |
| 7,118,285 | B2 | 10/2006 | Fenwick et al. |
| 7,118,382 | B2 | 10/2006 | Kerekes et al. |
| 7,118,416 | B2 | 10/2006 | Montena et al. |
| 7,125,283 | B1 | 10/2006 | Lin |
| 7,128,603 | B2 | 10/2006 | Burris et al. |
| 7,128,604 | B2 | 10/2006 | Hall |
| 7,131,867 | B1 | 11/2006 | Foster et al. |
| 7,131,868 | B2 | 11/2006 | Montena |
| 7,140,645 | B2 | 11/2006 | Cronley |
| 7,144,271 | B1 | 12/2006 | Burris et al. |
| 7,144,272 | B1 | 12/2006 | Burris et al. |
| 7,147,509 | B1 | 12/2006 | Burris et al. |
| 7,153,159 | B2 | 12/2006 | Burris et al. |
| 7,156,696 | B1 | 1/2007 | Montena |
| 7,161,785 | B2 | 1/2007 | Chawgo |
| 7,165,974 | B2 | 1/2007 | Kooiman |
| 7,168,992 | B2 | 1/2007 | Vo et al. |
| 7,173,121 | B2 | 2/2007 | Fang |
| 7,179,121 | B1 | 2/2007 | Burris et al. |
| 7,179,122 | B2 | 2/2007 | Holliday |
| 7,182,639 | B2 | 2/2007 | Burris |
| 7,183,639 | B2 | 2/2007 | Mihara et al. |
| 7,189,097 | B2 | 3/2007 | Benham |
| 7,189,114 | B1 | 3/2007 | Burris et al. |
| 7,192,308 | B2 | 3/2007 | Rodrigues et al. |
| 7,229,303 | B2 | 6/2007 | Vermoesen et al. |
| 7,238,047 | B2 | 7/2007 | Saetele et al. |
| 7,252,536 | B2 | 8/2007 | Lazaro, Jr. et al. |
| 7,252,546 | B1 | 8/2007 | Holland |
| 7,255,598 | B2 | 8/2007 | Montena et al. |
| 7,261,594 | B2 | 8/2007 | Kodama et al. |
| 7,264,502 | B2 | 9/2007 | Holland |
| 7,278,882 | B1 | 10/2007 | Li |
| 7,288,002 | B2 | 10/2007 | Rodrigues et al. |
| 7,229,550 | B2 | 11/2007 | Montena |
| 7,291,033 | B2 | 11/2007 | Hu |

(56) References Cited

U.S. PATENT DOCUMENTS

| | | | |
|---|---|---|---|
| 7,297,023 | B2 | 11/2007 | Chawgo |
| 7,299,550 | B2 | 11/2007 | Montena |
| 7,303,435 | B2 | 12/2007 | Burris et al. |
| 7,311,555 | B1 | 12/2007 | Burris et al. |
| 7,318,609 | B2 | 1/2008 | Naito et al. |
| 7,322,846 | B2 | 1/2008 | Camelio |
| 7,322,851 | B2 | 1/2008 | Brookmire |
| 7,329,139 | B2 | 2/2008 | Benham |
| 7,331,820 | B2 | 2/2008 | Burris et al. |
| 7,335,058 | B1 | 2/2008 | Burris et al. |
| 7,347,129 | B1 | 3/2008 | Youtsey |
| 7,347,726 | B2 | 3/2008 | Wlos |
| 7,347,727 | B2 | 3/2008 | Wlos et al. |
| 7,347,729 | B2 | 3/2008 | Thomas et al. |
| 7,351,088 | B1 | 4/2008 | Qu |
| 7,357,641 | B2 | 4/2008 | Kerekes et al. |
| 7,364,462 | B2 | 4/2008 | Holland |
| 7,371,112 | B2 | 5/2008 | Burris et al. |
| 7,371,113 | B2 | 5/2008 | Burris et al. |
| 7,375,533 | B2 | 5/2008 | Gale |
| 7,387,524 | B2 | 6/2008 | Cheng |
| 7,393,245 | B2 | 7/2008 | Palinkas et al. |
| 7,396,249 | B2 | 7/2008 | Kauffman |
| 7,404,737 | B1 | 7/2008 | Youtsey |
| 7,410,389 | B2 | 8/2008 | Holliday |
| 7,416,415 | B2 | 8/2008 | Hart et al. |
| 7,438,327 | B2 | 10/2008 | Auray et al. |
| 7,452,239 | B2 | 11/2008 | Montena |
| 7,455,550 | B1 | 11/2008 | Sykes |
| 7,458,850 | B1 | 12/2008 | Burris et al. |
| 7,458,851 | B2 | 12/2008 | Montena |
| 7,462,068 | B2 | 12/2008 | Amidon |
| 7,467,980 | B2 | 12/2008 | Chiu |
| 7,476,127 | B1 | 1/2009 | Wei |
| 7,478,475 | B2 | 1/2009 | Hall |
| 7,479,033 | B1 | 1/2009 | Sykes et al. |
| 7,479,035 | B2 | 1/2009 | Bence et al. |
| 7,484,988 | B2 | 2/2009 | Ma et al. |
| 7,484,997 | B2 | 2/2009 | Hofling |
| 7,488,210 | B1 | 2/2009 | Burris et al. |
| 7,494,355 | B2 | 2/2009 | Hughes et al. |
| 7,497,729 | B1 | 3/2009 | Wei |
| 7,500,868 | B2 | 3/2009 | Holland et al. |
| 7,500,873 | B1 | 3/2009 | Hart |
| 7,507,116 | B2 | 3/2009 | Laerke et al. |
| 7,507,117 | B2 | 3/2009 | Amidon |
| 7,513,788 | B2 | 4/2009 | Camelio |
| 7,513,795 | B1 | 4/2009 | Shaw |
| 7,537,482 | B2 | 5/2009 | Burris et al. |
| 7,540,759 | B2 | 6/2009 | Liu et al. |
| 7,544,094 | B1 | 6/2009 | Paglia et al. |
| 7,563,133 | B2 | 7/2009 | Stein |
| 7,566,236 | B2 | 7/2009 | Malloy et al. |
| 7,568,945 | B2 | 8/2009 | Chee et al. |
| 7,578,693 | B2 | 8/2009 | Yoshida et al. |
| 7,588,454 | B2 | 9/2009 | Nakata et al. |
| 7,588,460 | B2 | 9/2009 | Malloy et al. |
| 7,607,942 | B1 | 10/2009 | Van Swearingen |
| 7,625,227 | B1 | 12/2009 | Henderson et al. |
| 7,632,143 | B1 | 12/2009 | Islam |
| 7,635,283 | B1 | 12/2009 | Islam |
| 7,648,383 | B2 | 1/2010 | Burris et al. |
| 7,651,376 | B2 | 1/2010 | Schreier |
| 7,674,132 | B1 | 3/2010 | Chen |
| 7,682,177 | B2 | 3/2010 | Berthet |
| 7,682,188 | B1 | 3/2010 | Lu |
| 7,694,420 | B2 | 4/2010 | Ehret et al. |
| 7,714,229 | B2 | 5/2010 | Burris et al. |
| 7,726,996 | B2 | 6/2010 | Burris et al. |
| 7,727,011 | B2 | 6/2010 | Montena et al. |
| 7,749,021 | B2 | 7/2010 | Brodeur |
| 7,749,022 | B2 | 7/2010 | Amidon et al. |
| 7,753,705 | B2 | 7/2010 | Montena |
| 7,753,710 | B2 | 7/2010 | George |
| 7,753,727 | B1 | 7/2010 | Islam et al. |
| 7,758,356 | B2 | 7/2010 | Burris et al. |
| 7,758,370 | B1 | 7/2010 | Flaherty |
| 7,794,275 | B2 | 9/2010 | Rodrigues |
| 7,806,714 | B2 | 10/2010 | Williams et al. |
| 7,806,725 | B1 | 10/2010 | Chen |
| 7,811,133 | B2 | 10/2010 | Gray |
| 7,814,654 | B2 | 10/2010 | Pichler |
| D626,920 | S | 11/2010 | Purdy et al. |
| 7,824,216 | B2 | 11/2010 | Purdy |
| 7,828,594 | B2 | 11/2010 | Burris et al. |
| 7,828,595 | B2 | 11/2010 | Mathews |
| 7,830,154 | B2 | 11/2010 | Gale |
| 7,833,053 | B2 | 11/2010 | Mathews |
| 7,845,976 | B2 | 12/2010 | Mathews |
| 7,845,978 | B1 | 12/2010 | Chen |
| 7,845,980 | B1 | 12/2010 | Amidon |
| 7,850,472 | B2 | 12/2010 | Friedrich et al. |
| 7,850,487 | B1 | 12/2010 | Wei |
| 7,857,661 | B1 | 12/2010 | Islam |
| 7,874,870 | B1 | 1/2011 | Chen |
| 7,887,354 | B2 | 2/2011 | Holliday |
| 7,892,004 | B2 | 2/2011 | Hertzler et al. |
| 7,892,005 | B2 | 2/2011 | Haube |
| 7,892,024 | B1 | 2/2011 | Chen |
| 7,914,326 | B2 | 3/2011 | Sutter |
| 7,918,687 | B2 | 4/2011 | Paynter et al. |
| 7,927,135 | B1 | 4/2011 | Wlos |
| 7,934,954 | B1 | 5/2011 | Chawgo et al. |
| 7,934,955 | B1 | 5/2011 | Hsia |
| 7,938,662 | B2 | 5/2011 | Burris et al. |
| 7,942,695 | B1 | 5/2011 | Lu |
| 7,950,958 | B2 | 5/2011 | Mathews |
| 7,950,961 | B2 | 5/2011 | Chabalowski et al. |
| 7,955,126 | B2 | 6/2011 | Bence et al. |
| 7,972,158 | B2 | 7/2011 | Wild et al. |
| 7,972,176 | B2 | 7/2011 | Burris et al. |
| 7,982,005 | B2 | 7/2011 | Ames et al. |
| 8,011,955 | B1 | 9/2011 | Lu |
| 8,025,518 | B2 | 9/2011 | Burris et al. |
| 8,029,315 | B2 | 10/2011 | Purdy et al. |
| 8,029,316 | B2 | 10/2011 | Snyder et al. |
| 8,037,599 | B2 | 10/2011 | Pichler |
| 8,047,872 | B2 | 11/2011 | Burris et al. |
| 8,062,044 | B2 | 11/2011 | Montena et al. |
| 8,062,063 | B2 | 11/2011 | Malloy et al. |
| 8,070,504 | B2 | 12/2011 | Amidon et al. |
| 8,075,337 | B2 | 12/2011 | Malloy et al. |
| 8,075,338 | B1 | 12/2011 | Montena |
| 8,079,860 | B1 | 12/2011 | Zraik |
| 8,087,954 | B2 | 1/2012 | Fuchs |
| 8,113,875 | B2 | 2/2012 | Malloy et al. |
| 8,113,879 | B1 | 2/2012 | Zraik |
| 8,157,587 | B2 | 4/2012 | Paynter et al. |
| 8,157,588 | B1 | 4/2012 | Rodrigues et al. |
| 8,167,635 | B1 | 5/2012 | Mathews |
| 8,167,636 | B1 | 5/2012 | Montena |
| 8,172,612 | B2 | 5/2012 | Bence et al. |
| 8,177,572 | B2 | 5/2012 | Feye-Hohmann |
| 8,192,237 | B2 | 6/2012 | Purdy et al. |
| 8,206,172 | B2 | 6/2012 | Katagiri et al. |
| D662,893 | S | 7/2012 | Haberek et al. |
| 8,231,412 | B2 | 7/2012 | Paglia et al. |
| 8,262,408 | B1 | 9/2012 | Kelly |
| 8,272,893 | B2 | 9/2012 | Burris et al. |
| 8,287,310 | B2 | 10/2012 | Burris et al. |
| 8,287,320 | B2 | 10/2012 | Purdy et al. |
| 8,313,345 | B2 | 11/2012 | Purdy |
| 8,313,353 | B2 | 11/2012 | Purdy et al. |
| 8,317,539 | B2 | 11/2012 | Stein |
| 8,319,136 | B2 | 11/2012 | Byron et al. |
| 8,323,053 | B2 | 12/2012 | Montena |
| 8,323,058 | B2 | 12/2012 | Flaherty et al. |
| 8,323,060 | B2 | 12/2012 | Purdy et al. |
| 8,337,229 | B2 | 12/2012 | Montena |
| 8,366,481 | B2 | 2/2013 | Ehret et al. |
| 8,366,482 | B2 | 2/2013 | Burris et al. |
| 8,376,769 | B2 | 2/2013 | Holland et al. |
| D678,844 | S | 3/2013 | Haberek |
| 8,398,421 | B2 | 3/2013 | Haberek et al. |

(56) References Cited

U.S. PATENT DOCUMENTS 8,430,688 B2 4/2013 Montena et al.
8,449,326 B2 5/2013 Holland et al.
8,465,322 B2 6/2013 Purdy
8,469,739 B2 6/2013 Rodrigues et al.
8,469,740 B2 6/2013 Ehret et al.
D686,164 S 7/2013 Haberek et al.
D686,576 S 7/2013 Haberek et al.
8,475,205 B2 7/2013 Ehret et al.
8,480,430 B2 7/2013 Ehret et al.
8,480,431 B2 7/2013 Ehret et al.
8,485,845 B2 7/2013 Ehret et al.
8,506,325 B2 8/2013 Malloy et al.
8,517,763 B2 8/2013 Burris et al.
8,517,764 B2 8/2013 Wei et al.
8,529,279 B2 9/2013 Montena
8,550,835 B2 10/2013 Montena
8,556,656 B2 10/2013 Thomas et al.
8,568,163 B2 10/2013 Burris et al.
8,568,165 B2 10/2013 Wei et al.
8,591,244 B2 11/2013 Thomas et al.
8,597,050 B2 12/2013 Flaherty et al.
8,622,776 B2 1/2014 Morikawa
8,636,529 B2 1/2014 Stein
8,636,541 B2* 1/2014 Chastain ..... H01R 9/05 439/578
8,647,136 B2 2/2014 Purdy et al.
8,690,603 B2 4/2014 Bence et al.
8,721,365 B2 5/2014 Holland
8,727,800 B2 5/2014 Holland et al.
8,758,050 B2 6/2014 Montena
8,777,658 B2 7/2014 Holland et al.
8,777,661 B2 7/2014 Holland et al.
8,172,612 C1 9/2014 Bence et al.
8,834,200 B2 9/2014 Shaw
8,858,251 B2 10/2014 Montena
8,888,526 B2 11/2014 Burris
8,920,192 B2 12/2014 Montena
6,558,194 C1 1/2015 Montena
6,848,940 C1 1/2015 Montena
9,017,101 B2 4/2015 Ehret et al.
9,048,599 B2 6/2015 Burris
9,071,019 B2 6/2015 Burris et al.
9,136,654 B2* 9/2015 Matzen ..... H01R 24/38
9,153,911 B2 10/2015 Burris et al.
9,166,307 B2 10/2015 Shaw
9,166,348 B2 10/2015 Burris et al.
9,172,154 B2 10/2015 Burris
9,172,157 B2 10/2015 Burris
9,306,324 B2 4/2016 Wei
9,343,855 B2 5/2016 Wei
9,407,016 B2 8/2016 Burris
9,722,363 B2 8/2017 Burris et al.
2001/0034143 A1 10/2001 Annequin
2001/0046802 A1 11/2001 Perry et al.
2001/0051448 A1 12/2001 Gonzalez
2002/0013088 A1 1/2002 Rodrigues et al.
2002/0019161 A1 2/2002 Finke et al.
2002/0038720 A1 4/2002 Kai et al.
2002/0064014 A1 5/2002 Montena
2002/0146935 A1 10/2002 Wong
2003/0110977 A1 6/2003 Batlaw
2003/0119358 A1 6/2003 Henningsen
2003/0139081 A1 7/2003 Hall et al.
2003/0194890 A1 10/2003 Ferderer et al.
2003/0214370 A1 11/2003 Allison et al.
2003/0224657 A1 12/2003 Malloy
2004/0031144 A1 2/2004 Holland
2004/0077215 A1 4/2004 Palinkas et al.
2004/0102089 A1 5/2004 Chee
2004/0137778 A1 7/2004 Mattheeuws et al.
2004/0157499 A1 8/2004 Nania et al.
2004/0194585 A1 10/2004 Clark
2004/0209516 A1 10/2004 Burris et al.
2004/0219833 A1 11/2004 Burris et al.
2004/0229504 A1 11/2004 Liu
2005/0042919 A1 2/2005 Montena
2005/0079762 A1 4/2005 Hsia
2005/0159045 A1 7/2005 Huang
2005/0164553 A1 7/2005 Montena
2005/0170692 A1 8/2005 Montena
2005/0181652 A1 8/2005 Montena et al.
2005/0181668 A1 8/2005 Montena et al.
2005/0208827 A1 9/2005 Burris et al.
2005/0233636 A1 10/2005 Rodrigues et al.
2006/0014425 A1 1/2006 Montena
2006/0099853 A1 5/2006 Sattele et al.
2006/0110977 A1* 5/2006 Matthews ..... H01R 9/0524 439/578
2006/0113107 A1 6/2006 Williams
2006/0154519 A1 7/2006 Montena
2006/0166552 A1* 7/2006 Bence ..... H01R 9/05 439/578
2006/0178046 A1 8/2006 Tusini
2006/0194465 A1 8/2006 Czikora
2006/1078034 8/2006 Shimirak
2006/0199040 A1 9/2006 Yamada
2006/0223355 A1 10/2006 Hirschmann
2006/0246774 A1 11/2006 Buck
2006/0258209 A1 11/2006 Hall
2006/0276079 A1 12/2006 Chen
2007/0004276 A1 1/2007 Stein
2007/0026734 A1 2/2007 Bence et al.
2007/0049113 A1 3/2007 Rodrigues et al.
2007/0054535 A1 3/2007 Hall et al.
2007/0059968 A1 3/2007 Ohtaka et al.
2007/0082533 A1 4/2007 Currier et al.
2007/0087613 A1 4/2007 Schumacher et al.
2007/0093128 A1 4/2007 Thomas et al.
2007/0123101 A1 5/2007 Palinkas
2007/0155232 A1 7/2007 Burris et al.
2007/0155233 A1 7/2007 Laerke et al.
2007/0173100 A1 7/2007 Benham
2007/0175027 A1 8/2007 Khemakhem et al.
2007/0232117 A1 10/2007 Singer
2007/0243759 A1 10/2007 Rodrigues et al.
2007/0243762 A1 10/2007 Burke et al.
2007/0287328 A1 12/2007 Hart et al.
2008/0032556 A1 2/2008 Schreier
2008/0102696 A1 5/2008 Montena
2008/0171466 A1 7/2008 Buck et al.
2008/0200066 A1 8/2008 Hofling
2008/0200068 A1 8/2008 Aguirre
2008/0214040 A1 9/2008 Holterhoff et al.
2008/0274644 A1 11/2008 Rodrigues
2008/0289470 A1 11/2008 Aston
2008/0310026 A1 12/2008 Nakayama
2009/0029590 A1 1/2009 Sykes et al.
2009/0098770 A1 4/2009 Bence et al.
2009/0104801 A1 4/2009 Silva
2009/0163075 A1 6/2009 Blew et al.
2009/0186505 A1 7/2009 Mathews
2009/0264003 A1 10/2009 Hertzler et al.
2009/0305560 A1 12/2009 Chen
2010/0007441 A1 1/2010 Yagisawa et al.
2010/0022125 A1 1/2010 Burris et al.
2010/0028563 A1 2/2010 Ota
2010/0055978 A1 3/2010 Montena
2010/0080563 A1 4/2010 DiFonzo et al.
2010/0081321 A1 4/2010 Malloy et al.
2010/0081322 A1 4/2010 Malloy et al.
2010/0087071 A1 4/2010 DiFonzo et al.
2010/0105246 A1 4/2010 Burris et al.
2010/0124839 A1* 5/2010 Montena ..... H01R 13/6683 439/489
2010/0130060 A1 5/2010 Islam
2010/0178799 A1 7/2010 Lee
2010/0216339 A1 8/2010 Burris et al.
2010/0233901 A1 9/2010 Wild et al.
2010/0233902 A1 9/2010 Youtsey
2010/0233903 A1 9/2010 Islam
2010/0255719 A1 10/2010 Purdy
2010/0255720 A1 10/2010 Radzik et al.
2010/0255721 A1 10/2010 Purdy et al.
2010/0273351 A1 10/2010 Holliday

(56) References Cited

U.S. PATENT DOCUMENTS

| | | | | |
|---|---|---|---|---|
| 2010/0279548 | A1 | 11/2010 | Montena et al. | |
| 2010/0297871 | A1 | 11/2010 | Haube | |
| 2010/0297875 | A1* | 11/2010 | Purdy | H01R 9/0524 439/578 |
| 2010/0304579 | A1 | 12/2010 | Kisling | |
| 2010/0323541 | A1 | 12/2010 | Amidon et al. | |
| 2011/0021072 | A1 | 1/2011 | Purdy | |
| 2011/0021075 | A1 | 1/2011 | Orner et al. | |
| 2011/0027039 | A1 | 2/2011 | Blair | |
| 2011/0039448 | A1 | 2/2011 | Stein | |
| 2011/0053413 | A1 | 3/2011 | Mathews | |
| 2011/0074388 | A1 | 3/2011 | Bowman | |
| 2011/0080158 | A1 | 4/2011 | Lawrence et al. | |
| 2011/0111623 | A1 | 5/2011 | Burris et al. | |
| 2011/0111626 | A1 | 5/2011 | Paglia et al. | |
| 2011/0117774 | A1 | 5/2011 | Malloy et al. | |
| 2011/0143567 | A1 | 6/2011 | Purdy et al. | |
| 2011/0151714 | A1 | 6/2011 | Flaherty et al. | |
| 2011/0230089 | A1 | 9/2011 | Amidon et al. | |
| 2011/0230091 | A1 | 9/2011 | Krenceski et al. | |
| 2011/0237123 | A1 | 9/2011 | Burris et al. | |
| 2011/0237124 | A1 | 9/2011 | Flaherty et al. | |
| 2011/0250789 | A1 | 10/2011 | Burris et al. | |
| 2011/0318958 | A1 | 12/2011 | Burris et al. | |
| 2012/0021642 | A1 | 1/2012 | Zraik | |
| 2012/0040537 | A1 | 2/2012 | Burris | |
| 2012/0045933 | A1* | 2/2012 | Youtsey | H01R 9/05 439/578 |
| 2012/0064768 | A1 | 3/2012 | Islam et al. | |
| 2012/0094530 | A1 | 4/2012 | Montena | |
| 2012/0100751 | A1 | 4/2012 | Montena | |
| 2012/0108098 | A1 | 5/2012 | Burris et al. | |
| 2012/0122329 | A1* | 5/2012 | Montena | H01R 9/05 439/271 |
| 2012/0129387 | A1 | 5/2012 | Holland et al. | |
| 2012/0159740 | A1 | 6/2012 | Strelow et al. | |
| 2012/0171894 | A1 | 7/2012 | Malloy et al. | |
| 2012/0178289 | A1 | 7/2012 | Holliday | |
| 2012/0202378 | A1 | 8/2012 | Krenceski et al. | |
| 2012/0222302 | A1 | 9/2012 | Purdy et al. | |
| 2012/0225581 | A1 | 9/2012 | Amidon et al. | |
| 2012/0315788 | A1 | 12/2012 | Montena | |
| 2012/0329311 | A1 | 12/2012 | Duval et al. | |
| 2013/0059468 | A1 | 3/2013 | Wood | |
| 2013/0065433 | A1 | 3/2013 | Burris | |
| 2013/0072057 | A1 | 3/2013 | Burris | |
| 2013/0178096 | A1 | 7/2013 | Matzen | |
| 2013/0273761 | A1 | 10/2013 | Ehret et al. | |
| 2014/0106612 | A1 | 4/2014 | Burris | |
| 2014/0106614 | A1 | 4/2014 | Burris et al. | |
| 2014/0120766 | A1 | 5/2014 | Meister et al. | |
| 2014/0137393 | A1 | 5/2014 | Chastain et al. | |
| 2014/0148044 | A1* | 5/2014 | Balcer | H01R 9/0524 439/460 |
| 2014/0148051 | A1 | 5/2014 | Bence et al. | |
| 2014/0154907 | A1 | 6/2014 | Ehret et al. | |
| 2014/0106613 | A1 | 7/2014 | Burris | |
| 2014/0298650 | A1 | 10/2014 | Chastain et al. | |
| 2014/0322968 | A1 | 10/2014 | Burris | |
| 2014/0342605 | A1 | 11/2014 | Burris et al. | |
| 2015/0118901 | A1 | 4/2015 | Burris | |
| 2015/0295331 | A1 | 10/2015 | Burris | |
| 2016/0118727 | A1 | 4/2016 | Burris et al. | |
| 2016/0118748 | A1 | 4/2016 | Burris et al. | |
| 2017/0025801 | A1 | 1/2017 | Edmonds | |

FOREIGN PATENT DOCUMENTS

| | | |
|---|---|---|
| CN | 1292940 | 4/2001 |
| CN | 201149936 | 11/2008 |
| CN | 201149937 | 11/2008 |
| CN | 201178228 | 1/2009 |
| CN | 201904508 | 7/2011 |
| DE | 3117320 | 4/1982 |
| DE | 3211008 | 10/1983 |
| DE | 4439852 | 5/1996 |
| DE | 19749130 | 8/1999 |
| DE | 19957518 | 9/2001 |
| DE | 10346914 | 5/2004 |
| DE | 102004031271 | 1/2006 |
| DE | 102010064071 | 12/2010 |
| EP | 115179 | 8/1984 |
| EP | 116157 | 8/1984 |
| EP | 167738 | 1/1986 |
| EP | 72104 | 2/1986 |
| EP | 223464 | 5/1987 |
| EP | 265276 | 4/1988 |
| EP | 350835 | 1/1990 |
| EP | 428424 | 5/1991 |
| EP | 867978 | 9/1998 |
| EP | 1069654 | 9/1998 |
| EP | 1094565 | 4/2001 |
| EP | 1115179 | 7/2001 |
| EP | 1191268 | 3/2002 |
| EP | 1455420 | 9/2004 |
| EP | 1501159 | 1/2005 |
| EP | 1548898 | 6/2005 |
| EP | 1603200 | 12/2005 |
| EP | 1701410 | 9/2006 |
| EP | 2051340 | 4/2009 |
| FR | 2204331 | 5/1974 |
| FR | 2462798 | 2/1981 |
| FR | 2494508 | 5/1982 |
| GB | 589697 | 6/1947 |
| GB | 1010372 | 11/1963 |
| GB | 1087228 | 10/1967 |
| GB | 1270846 | 4/1972 |
| GB | 1332888 | 10/1973 |
| GB | 1401373 | 7/1975 |
| GB | 1421215 | 1/1976 |
| GB | 2019665 | 10/1979 |
| GB | 2079549 | 1/1982 |
| GB | 2252677 | 8/1992 |
| GB | 2264201 | 8/1993 |
| GB | 2331634 | 5/1999 |
| GB | 2448595 | 10/2008 |
| GB | 2450248 | 12/2008 |
| JP | 3280369 | 12/1991 |
| JP | 2000-40564 | 2/2000 |
| JP | 2002-015823 | 1/2002 |
| JP | 200215823 | 1/2002 |
| JP | 4129978 | 8/2008 |
| JP | 4219778 | 2/2009 |
| JP | 2009277571 | 11/2009 |
| JP | 4391268 | 12/2009 |
| JP | 4503793 | 7/2010 |
| KR | 100622526 | 9/2006 |
| TW | 427044 | 3/2001 |
| TW | 200810279 | 2/2008 |
| TW | 200843262 | 11/2008 |
| TW | 201140953 | 11/2011 |
| WO | 8700351 | 1/1987 |
| WO | 9908343 | 2/1999 |
| WO | 186756 | 11/2001 |
| WO | 2069457 | 9/2002 |
| WO | 2004013883 | 2/2004 |
| WO | 2004098795 | 11/2004 |
| WO | 2006081141 | 8/2006 |
| WO | 2007062845 | 6/2007 |
| WO | 2009066705 | 5/2009 |
| WO | 2010135181 | 11/2010 |
| WO | 2011057033 | 5/2011 |
| WO | 2012162431 | 5/2011 |
| WO | 2011128665 | 10/2011 |
| WO | 2011128666 | 10/2011 |
| WO | 2013126629 | 8/2013 |

OTHER PUBLICATIONS

Corning Gilbert 2004 OEM Coaxial Products Catalog, Quick Disconnects, 2 pages.

(56) References Cited

OTHER PUBLICATIONS

Digicon AVL Connector. ARRIS Group Inc. [online] 3 pages. Retrieved from the Internet: <URL: http://www.arrisi.com/special/digiconAVL.asp.
U.S. Office Action, U.S. Appl. No. 10/997,218; dated Jul. 31, 2006, pp. 1-10.
Society of Cable Telecommunications Engineers, Engineering Committee, Interface Practices Subcommittee; American National Standard; ANSI/SCTE Jan. 2006; "Specification for F" Port, Female, Outdoor. Published Jan. 2006. 9 pages.
The American Society of Mechanical Engineers; "Lock Washers (Inch Series), An American National Standard"; ASME 818.21.1-1999 (Revision of ASME B18.21.1-1994); Reaffirmed 2005. Published Feb. 11, 2000. 28 pages.
U.S. Reexamination Control No. 90/012,300, filed Jun. 29, 2012, regarding U.S. Pat. No. 8,172,612 filed May 27, 2011 (Bence et al.).
U.S. Reexamination Control No. 90/012,749, filed Dec. 21, 2012, regarding U.S. Pat. No. 7,114,990, filed Jan. 25, 2005 (Bence et al.).
U.S. Reexamination Control No. 90/012,835, filed Apr. 11, 2013, regarding U.S. Pat. No. 8,172,612 filed May 27, 2011 (Bence et al.).
Notice of Allowance (dated Mar. 20, 2012) for U.S. Appl. No. 13/117,843.
Search Report dated Jun. 6, 2014 pertaining to International application No. PCT/US2014/023374.
Search Report dated Apr. 9, 2014 pertaining to International application No. PCT/US2014/015934.
Society of Cable Telecommunications Engineers, Engineering Committee, Interface Practices Subcommittee; American National Standard; ANSI/SCTE Feb. 2006; "Specification for "F" Port, Female, Indoor". Published Feb. 2006. 9 pages.
PPC, "Next Generation Compression Connectors," pp. 1-6, Retrieved from http://www.tessco.com/yts/partnermanufacturerlist/vendors/ppc/pdf/ppcdigitalspread.pdf.
Patent Cooperation Treaty, International Search Report for PCT/US2013/070497, dated Feb. 11, 2014, 3 pgs.
Patent Cooperation Treaty, International Search Report for PCT/US2013/064515, 10 pgs.
Patent Cooperation Treaty, International Search Report for PCT/US2013/064512, dated Jan. 21, 2014, 11 pgs.
Huber+Suhner AG, RF Connector Guide: Understanding connector technology, 2007, Retrieved from http://www.ie.itcr.ac.cr/marin/lic/e14515/Huber+Suener_RF_Connector_Guide.pdf.
Slade, Paul G,. Electrical Contacts: Principles and Applications, 1999, Retrieved from http://books.google.com/books (table of contents only).
U.S. Reexamination Control No. 95/002,400, filed Sep. 15, 2012, regarding U.S. Pat. No. 8,192,237 filed Feb. 23, 2011 (Purdy et al.).
U.S. Reexamination Control No. 90/013,068, filed Nov. 27, 2013, regarding U.S. Pat. No. 6,558,194 filed Jul. 21, 2000 (Montena).
U.S. Reexamination Control No. 90/013,069, filed Nov. 27, 2013, regarding U.S. Pat. No. 6,848,940 filed Jan. 21, 2003 (Montena).
U.S. *Inter Partes* Review Case No. 2013-00346 filed Jun. 10, 2013, regarding U.S. Pat. No. 8,287,320 filed Dec. 8, 2009, claims 1-8, 10-16, 18-31 (Purdy et al.).
U.S. *Inter Partes* Review Case No. 2013-00343 filed Jun. 10, 2013, regarding U.S. Pat. No. 8,313,353 filed Apr. 30, 2012, claims 1-6 (Purdy et al.).
U.S. *Inter Partes* Review Case No. 2013-00340 filed Jun. 10, 2013, regarding U.S. Pat. No. 8,323,060 filed Jun. 14, claims 1-9 (Purdy et al.).
U.S. *Inter Partes* Review Case No. 2013-00347 filed Jun. 10, 2013, regarding U.S. Pat. No. 8,287,320 filed Dec. 8, 2009, claims 9, 17, 32 (Purdy et al.).
U.S. *Inter Partes* Review Case No. 2013-00345 filed Jun. 10, 2013, regarding U.S. Pat. No. 8,313,353 filed Apr. 30, 2012, claims 7-27 (Purdy et al.).
U.S. *Inter Partes* Review Case No. 2013-00342 filed Jun. 10, 2013, regarding U.S. Pat. No. 8,323,060 filed Jun. 14, 2012, claims 10-25 (Purdy et al.).
U.S. *Inter Partes* Review Case No. 2014-00441 filed Feb. 18, 2014, regarding U.S. Pat. No. 8,562,366 filed Oct. 15, 2012, claims 31,37, 39, 41, 42, 55 56 (Purdy et al.).
U.S. *Inter Partes* Review Case No. 2014-00440 filed Feb. 18, 2014, regarding U.S. Pat. No. 8,597,041 filed Oct. 15, 2012, claims 1, 8, 9, 11, 18-26, 29 (Purdy et al.).
Office Action dated Jun. 12, 2014 pertaining to U.S. Appl. No. 13/795,737.
Office Action dated Aug. 25, 2014 pertaining to U.S. Appl. No. 13/605,481.
Election/Restrictions Requirement dated Jul. 31, 2014 pertaining to U.S. Appl. No. 13/652,969.
Office Action dated Aug. 29, 2014 pertaining to U.S. Appl. No. 13/827,522.
Election/Restrictions Requirement dated Jun. 20, 2014 pertaining to U.S. Appl. No. 13/795,780.
Office Action dated Sep. 19, 2014 pertaining to U.S. Appl. No. 13/795,780.
Office Action dated Oct. 6, 2014 pertaining to U.S. Appl. No. 13/732,679.
Corning Cabelcon waterproof CX3 7.0 QuickMount for RG6 cables; Cabelcon Connectors; www.cabelcom.dk; Mar. 15, 2012.
Maury Jr., M.; Microwave Coaxial Connector Technology: A Continuaing Evolution; Maury Microwave Corporation; Dec. 13, 2005; pp. 1-21; Maury Microwave Inc.
"Snap-On/Push-On" SMA Adapter; RF TEC Mfg., Inc.; Mar. 23, 2006; 2 pgs.
RG6 quick mount data sheet; Corning Cabelcon; 2010; 1 pg.; Corning Cabelcon ApS.
RG11 quick mount data sheet; Corning Cabelcon; 2013; 1 pg.; Corning Cabelcon ApS.
Gilbert Engineering Co., Inc.; OEM Coaxial Connectors catalog; Aug. 1993; p. 26.
UltraEase Compression Connectors; "F" Series 59 and 6 Connectors Product Information; May 2005; 4 pgs.
Pomona Electronics Full Line Catelog; vol. 50; 2003; pp. 1-100.
Office Action dated Dec. 31, 2014 pertaining to U.S. Appl. No. 13/605,498.
Office Action dated Dec. 16, 2014 pertaining to U.S. Appl. No. 13/653,095.
Office Action dated Dec. 19, 2014 pertaining to U.S. Appl. No. 13/652,969.
Office Action dated Dec. 29, 2014 pertaining to U.S. Appl. No. 13/833,793.
Notice of Allowance dated Feb. 2, 2015 pertaining to U.S. Appl. No. 13/795,737.
Office Action dated Feb. 25, 2015 pertaining to U.S. Appl. No. 13/605,481.
Office Action dated Feb. 18, 2015 pertaining to U.S. Appl. No. 13/827,522.
Office Action dated Mar. 19, 2015 pertaining to U.S. Appl. No. 13/795,780.
Patent Cooperation Treaty, International Search Report for PCT/US2014/037841, dated Aug. 19, 2014, 3 pages.
Office Action dated Jun. 24, 2015 pertaining to U.S. Appl. No. 13/652,969.
Patent Cooperation Treaty, International Preliminary Report on Patentability for PCT/US2013/064512, dated Apr. 30, 2015, 9 pages.
Patent Cooperation Treaty, International Preliminary Report on Patentability for PCT/US2013/064515, dated Apr. 30, 2015, 8 pages.
Office Action dated Jun. 24, 2015 pertaining to U.S. Appl. No. 14/259,703.
Office Action dated Jul. 20, 2015 pertaining to U.S. Appl. No. 14/279,870.
Office Action dated Feb. 2, 2016 pertaining to U.S. Appl. No. 14/259,703.
Office Action dated Oct. 7, 2015 pertaining to U.S. Appl. No. 13/927,537.
Search Report dated Oct. 7, 2014 pertaining to International application No. PCT/US2014/043311.

(56) References Cited

OTHER PUBLICATIONS

Report on the Filing or Determination of an Action Regarding a Patent or Trademark regarding U.S. Pat. No. 8,313,353; 8,313,345; 8,323,060—Eastern District of Arkansas.
Report on the Filing or Determination of an Action Regarding a Patent or Trademark regarding U.S. Pat. No. 8,192,237; 8,287,320; 8,313,353; 8,323,060—Northern District of New York.
Report on the Filing or Determination of an Action Regarding a Patent or Trademark regarding U.S. Pat. No. 8,562,366—Northern District of New York.
Office Action dated Mar. 10, 2016 pertaining to U.S. Appl. No. 14/166,653.
European Search Report dated Apr. 8, 2015 pertaining to European Patent Application No. 13733586.5.
Search Report dated Mar. 19, 2013 pertaining to International application No. PCT/US2013/20001.
Office Action dated Feb. 29, 2016 pertaining to U.S. Appl. No. 14/795,367.
Office Action dated May 3, 2016 pertaining to U.S. Appl. No. 14/750,435.
Office Action dated May 20, 2016 pertaining to U.S. Appl. No. 13/927,537.
Chinese Search Report dated Jan. 19, 2016 pertaining to Chinese Application No. 2013800048358.
Taiwan Search Report dated Mar. 28, 2016 pertaining to Taiwanese Application No. 102100147.
Office Action dated Aug. 26, 2016 pertaining to U.S. Appl. No. 15/019,498.
Office Action dated Sep. 1, 2016 pertaining to U.S. Appl. No. 14/259,703.
Office Action dated Sep. 23, 2016 pertaining to U.S. Appl. No. 14/872,842.
Notice of Allowance dated Sep. 23, 2016 pertaining to U.S. Appl. No. 13/927,537.
Notice of Allowance dated Sep. 19, 2016 pertaining to U.S. Appl. No. 14/928,552.
Office Action dated Jul. 5, 2016 pertaining to U.S. Appl. No. 14/795,367.
Office Action dated Nov. 7, 2016 pertaining to U.S. Appl. No. 15/278,825.
Corning Cablecon CX3 Compression Catalogue; Rev. May 2012; 16 pages.
International Search Report and Written Opinion of the International Searching Authority; PCT/US2016/017294; dated May 11, 2016.
TW102137009 Search Report dated Sep. 26, 2016; 1 page, Taiwan Patent Office.
Office Action dated Jan. 20, 2017 pertaining to U.S. Appl. No. 14/797,575.
Office Action dated Nov. 29, 2016 pertaining to U.S. Appl. No. 14/844,592.
Apple Rubber Products Seal Design Guide 75; Mary K. Chaffee et al eds.; 2009; available at http://www.applerubber.com/src/pdf/seal-design-guide.pdf.
Whitlock, J. et al.; The Seal Man's O'Ring Handbook; Eric Jackson ed.; EPM, Inc.; 1st ed. 2004; pp. 1-36; available at https://www.physics.harvard.edu/uploads/files/machineshop/epm_oring_handbook.pdf.
O-Ring Identification Chart; Universal Air Conditioner, Inc.; available at https://www.uacparts.com/Downloads/UAC%20Oring%20Chart.pdf.
Office Action dated May 5, 2017 pertaining to U.S. Appl. No. 15/255,625.
Office Action dated Jul. 25, 2017 pertaining to U.S. Appl. No. 14/259,703.
Ex Parte Quayle dated May 18, 2017 pertaining to U.S. Appl. No. 15/342,709.
Office Action dated May 9, 2017 pertaining to U.S. Appl. No. 14/884,385.
Office Action dated Aug. 29, 2017 pertaining to U.S. Appl. No. 15/342,598.
Office Action dated Sep. 21, 2017 pertaining to U.S. Appl. No. 14/797,575.
Office Action dated Sep. 6, 2017 pertaining to U.S. Appl. No. 14/844,592.
Office Action dated Sep. 14, 2018 pertaining to U.S. Appl. No. 15/698,784.

* cited by examiner

COAXIAL CABLE CONNECTOR WITH INTEGRAL RFI PROTECTION

RELATED APPLICATIONS

This application is a continuation of U.S. application Ser. No. 15/636,842, filed Jun. 29, 2017, entitled "Coaxial Cable Connector with Integral RFI Protection," which is a continuation of U.S. application Ser. No. 15/019,498, filed Feb. 9, 2016, entitled "Coaxial Cable Connector With Integral RFI Protection," which is a continuation of U.S. application Ser. No. 13/653,095, filed Oct. 16, 2012, entitled "Coaxial Cable Connector With Integral RFI Protection," the disclosures of which are incorporated herein by reference in their entirety.

This application is related to U.S. application Ser. No. 13/198,765, filed Aug. 5, 2011, entitled "Coaxial Cable Connector with Radio Frequency Interference and Grounding Shield," which is incorporated herein by reference in its entirety.

This application is also related to U.S. application Ser. No. 13/652,969, filed Oct. 16, 2012, entitled "Coaxial Cable Connector with Continuity Contacting Portion," which is incorporated herein by reference in its entirety.

BACKGROUND

Field of the Disclosure

The technology of the disclosure relates to coaxial cable connectors and, in particular, to a coaxial cable connector that provides integral radio frequency interference (RFI) shielding.

Technical Background

Coaxial cable connectors, such as type F connectors, are used to attach coaxial cable to another object or appliance, e.g., a television set, DVD player, modem or other electronic communication device having a terminal adapted to engage the connector. The terminal of the appliance includes an inner conductor and a surrounding outer conductor.

Coaxial cable includes a center conductor for transmitting a signal. The center conductor is surrounded by a dielectric material, and the dielectric material is surrounded by an outer conductor; this outer conductor may be in the form of a conductive foil and/or braided sheath. The outer conductor is typically maintained at ground potential to shield the signal transmitted by the center conductor from stray noise, and to maintain a continuous desired impedance over the signal path. The outer conductor is usually surrounded by a plastic cable jacket that electrically insulates, and mechanically protects, the outer conductor. Prior to installing a coaxial connector onto an end of the coaxial cable, the end of the coaxial cable is typically prepared by stripping off the end portion of the jacket to expose the end portion of the outer conductor. Similarly, it is common to strip off a portion of the dielectric to expose the end portion of the center conductor.

Coaxial cable connectors of the type known in the trade as "F connectors" often include a tubular post designed to slide over the dielectric material, and under the outer conductor of the coaxial cable, at the prepared end of the coaxial cable. If the outer conductor of the cable includes a braided sheath, then the exposed braided sheath is usually folded back over the cable jacket. The cable jacket and folded-back outer conductor extend generally around the outside of the tubular post and are typically received in an outer body of the connector; this outer body of the connector is often fixedly secured to the tubular post. A coupler is typically rotatably secured around the tubular post and includes an internally-threaded region for engaging external threads formed on the outer conductor of the appliance terminal.

When connecting the end of a coaxial cable to a terminal of a television set, equipment box, modem, computer or other appliance, it is important to achieve a reliable electrical connection between the outer conductor of the coaxial cable and the outer conductor of the appliance terminal. Typically, this goal is usually achieved by ensuring that the coupler of the connector is fully tightened over the connection port of the appliance. When fully tightened, the head of the tubular post of the connector directly engages the edge of the outer conductor of the appliance port, thereby making a direct electrical ground connection between the outer conductor of the appliance port and the tubular post; in turn, the tubular post is engaged with the outer conductor of the coaxial cable.

With the increased use of self-install kits provided to home owners by some CATV system operators has come a rise in customer complaints due to poor picture quality in video systems and/or poor data performance in computer/internet systems. Additionally, CATV system operators have found upstream data problems induced by entrance of unwanted radio frequency ("RF") signals into their systems. Complaints of this nature result in CATV system operators having to send a technician to address the issue. Often times it is reported by the technician that the cause of the problem is due to a loose F connector fitting, sometimes as a result of inadequate installation of the self-install kit by the homeowner. An improperly installed or loose connector may result in poor signal transfer because there are discontinuities along the electrical path between the devices, resulting in ingress of undesired RF signals where RF energy from an external source or sources may enter the connector/cable arrangement causing a signal to noise ratio problem resulting in an unacceptable picture or data performance. In particular, RF signals may enter CATV systems from wireless devices, such as cell phones, computers and the like, especially in the 700-800 MHz transmitting range.

Many of the current state of the art F connectors rely on intimate contact between the F male connector interface and the F female connector interface. If, for some reason, the connector interfaces are allowed to pull apart from each other, such as in the case of a loose F male coupler, an interface "gap" may result. If not otherwise protected this gap can be a point of RF ingress as previously described.

A shield that completely surrounds or encloses a structure or device to protect it against RFI is typically referred to as a "Faraday cage." However, providing such RFI shielding within given structures is complicated when the structure or device comprises moving parts, such as seen in a coaxial connector. Accordingly, creating a connector to act in a manner similar to a Faraday cage to prevent ingress and egress of RF signals can be especially challenging due to the necessary relative movement between connector components required to couple the connector to a related port. Relative movement of components due to mechanical clearances between the components can result in an ingress or egress path for unwanted RF signals and, further, can disrupt the electrical and mechanical communication between components necessary to provide a reliable ground path. The effort to shield and electrically ground a coaxial connector is further complicated when the connector is required to perform when improperly installed, i.e. not tightened to a corresponding port.

U.S. Pat. No. 5,761,053 to, teaches that "[e]lectromagnetic interference (EMI) has been defined as undesired conducted or radiated electrical disturbances from an electrical or electronic apparatus, including transients, which can interfere with the operation of other electrical or electronic apparatus. Such disturbances can occur anywhere in the electromagnetic spectrum. Radio frequency interference (RFI) is often used interchangeably with electromagnetic interference, although it is more properly restricted to the radio frequency portion of the electromagnetic spectrum, usually defined as between 24 kilohertz (kHz) and 240 gigahertz (GHz). A shield is defined as a metallic or otherwise electrically conductive configuration inserted between a source of EMI/RFI and a desired area of protection. Such a shield may be provided to prevent electromagnetic energy from radiating from a source. Additionally, such a shield may prevent external electromagnetic energy from entering the shielded system. As a practical matter, such shields normally take the form of an electrically conductive housing which is electrically grounded. The energy of the EMI/RFI is thereby dissipated harmlessly to ground. Because EMI/RFI disrupts the operation of electronic components, such as integrated circuit (IC) chips, IC packages, hybrid components, and multi-chip modules, various methods have been used to contain EMI/RFI from electronic components. The most common method is to electrically ground a "can", that will cover the electronic components, to a substrate such as a printed wiring board. As is well known, a can is a shield that may be in the form of a conductive housing, a metallized cover, a small metal box, a perforated conductive case wherein spaces are arranged to minimize radiation over a given frequency band, or any other form of a conductive surface that surrounds electronic components. When the can is mounted on a substrate such that it completely surrounds and encloses the electronic components, it is often referred to as a Faraday Cage. Presently, there are two predominant methods to form a Faraday cage around electronic components for shielding use. A first method is to solder a can to a ground strip that surrounds electronic components on a printed wiring board (PWB). Although soldering a can provides excellent electrical properties, this method is often labor intensive. Also, a soldered can is difficult to remove if an electronic component needs to be re-worked. A second method is to mechanically secure a can, or other enclosure, with a suitable mechanical fastener, such as a plurality of screws or a clamp, for example. Typically, a conductive gasket material is usually attached to the bottom surface of a can to ensure good electrical contact with the ground strip on the PWB. Mechanically securing a can facilitates the re-work of electronic components, however, mechanical fasteners are bulky and occupy "valuable" space on a PWB."

Coaxial cable connectors have attempted to address the above problems by incorporating a continuity member into the coaxial cable connector as a separate component. In this regard, FIG. 1 illustrates a connector 1000 in the prior art having a coupler 2000, a separate post 3000, a separate continuity member 4000, and a body 5000. In connector 1000 the separate continuity member 4000 is captured between post 3000 and body 5000 and contacts at least a portion of coupler 2000. Coupler 2000 is preferably made of metal such as brass and plated with a conductive material such as nickel. Post 3000 is preferably made of metal such as brass and plated with a conductive material such as tin. Separate conductive member 4000 is preferably made of metal such as phosphor bronze and plated with a conductive material such as tin. Body 5000 is preferably made of metal such as brass and plated with a conductive material such as nickel.

SUMMARY OF THE DETAILED DESCRIPTION

Embodiments disclosed herein include a coaxial cable connector having an inner conductor, a dielectric surrounding the inner conductor, an outer conductor surrounding the dielectric, and a jacket surrounding the outer conductor and used for coupling an end of a coaxial cable to an equipment connection port. The coaxial cable comprises a coupler, a body and a post. The coupler is adapted to couple the connector to the equipment connection port. The coupler and post provide RF shielding provides RF shielding of the assembled coaxial cable connector such that RF signals external to the coaxial cable connector are attenuated by at least about 50 dB in a range up to about 1000 MHz. A transfer impedance measured averages about 0.24 ohms. The integrity of an electrical signal transmitted through coaxial cable connector is maintained regardless of the tightness of the coupling of the connector to the equipment connection port.

The RF signals external to the connector may be understood to mean RF signals that ingress into the connector. The RF signals external to the connector may also be understood to mean RF signals that egress out from the connector. The coupler may have a step and the post may have a flange, a contacting portion and a shoulder. A first circuitous path may be established by the a step, the flange, the contacting portion and the shoulder. The first circuitous path attenuates RF signals external to the connector.

The coupler may have a threaded portion adapted to connect with a threaded portion of the equipment connection port. At least one thread on the coupler may have a pitch angle different than a pitch angle of at least one thread of the equipment connection port. The pitch angle of the thread of the coupler may be about 2 degrees different than the pitch angle of the thread of the equipment connection port. The pitch angle of the thread of the coupler may be about 62 degrees, and the pitch angle of the thread of the equipment connection port may be about 60 degrees. The threaded portion of the coupler and the threaded portion of the equipment connection port may establish a second circuitous path, and the second circuitous path may attenuate RF signals external to the connector.

In yet another aspect, embodiments disclosed herein include a coaxial cable connector having an inner conductor, a dielectric surrounding the inner conductor, an outer conductor surrounding the dielectric, and a jacket surrounding the outer conductor and used for coupling an end of a coaxial cable to an equipment connection port. The coaxial cable comprises a coupler, a body and a post. The post comprises an integral contacting portion. The contacting portion is monolithic with at least a portion of the post. When assembled the coupler and post provide at least one circuitous path resulting in RF shielding such that RF signals external to the coaxial cable connector are attenuated, such that the integrity of an electrical signal transmitted through coaxial cable connector is maintained regardless of the tightness of the coupling of the connector to the terminal.

RF signals external to the coaxial connector comprise at least one of RF signals that ingress into the connector and RF signals that egress out from the connector. RF signals are attenuated by at least about 50 dB in a range up to about 1000 MHz and a transfer impedance averages about 0.24 ohms. The at least one circuitous path comprises a first circuitous path and a second circuitous path. The coupler comprises a lip and a step, and the post comprises a flange and a shoulder. The first circuitous path is established by at least one of the step, the lip, the flange, the contacting portion and the shoulder. The terminal comprises an equipment connection port, and the coupler comprises a threaded portion adapted to connect with a threaded portion of the equipment connection port, and the threaded portion of the coupler and the threaded portion of the equipment connection port establish a second circuitous path. At least one thread on the coupler has a pitch angle different than a pitch angle of at least one thread of the equipment connection port.

In yet another aspect, embodiments disclosed herein include a coaxial cable connector having an inner conductor, a dielectric surrounding the inner conductor, an outer conductor surrounding the dielectric, and a jacket surrounding the outer conductor and used for coupling an end of a coaxial cable to an equipment connection port. The coaxial cable comprises a coupler, a body and a post. The coupler is adapted to couple the connector to the equipment connection port. The coupler has a step and a threaded portion adapted to connect with a threaded portion of the equipment connection port. At least one thread on the coupler has a pitch angle different than a pitch angle of at least one thread of the equipment connection port. The body is assembled with the coupler. The post is assembled with the coupler and the body and is adapted to receive an end of a coaxial cable. The post comprises a flange, a contacting portion and a shoulder.

A first circuitous path is established by the a step, the flange, the contacting portion and the shoulder. A second circuitous path is established by the threaded portion of the coupler and the threaded portion of the equipment connection port. The first circuitous path and the second circuitous path provide for RF shielding of the assembled coaxial cable connector wherein RF signals external to the coaxial cable connector are attenuated by at least about 50 dB in a range up to about 1000 MHz, and the integrity of an electrical signal transmitted through coaxial cable connector is maintained regardless of the tightness of the coupling of the connector to the equipment connection port. A transfer impedance averages about 0.24 ohms. Additionally, the pitch angle of the thread of the coupler may be about 2 degrees different than the pitch angle of the thread of the equipment connection port. As a non-limiting example, the pitch angle of the thread of the coupler may be about 62 degrees, and the pitch angle of the thread of the equipment connection port is about 60 degrees.

Additional features and advantages are set out in the detailed description which follows, and in part will be readily apparent to those skilled in the art from that description or recognized by practicing the embodiments as described herein, including the detailed description, the claims, as well as the appended drawings.

It is to be understood that both the foregoing general description and the following detailed description are merely exemplary, and are intended to provide an overview or framework to understanding the nature and character of the claims. The accompanying drawings are included to provide a further understanding, and are incorporated in and constitute a part of this specification. The drawings illustrate one or more embodiment(s), and together with the description serve to explain principles and operation of the various embodiments.

DETAILED DESCRIPTION

Figure 1:
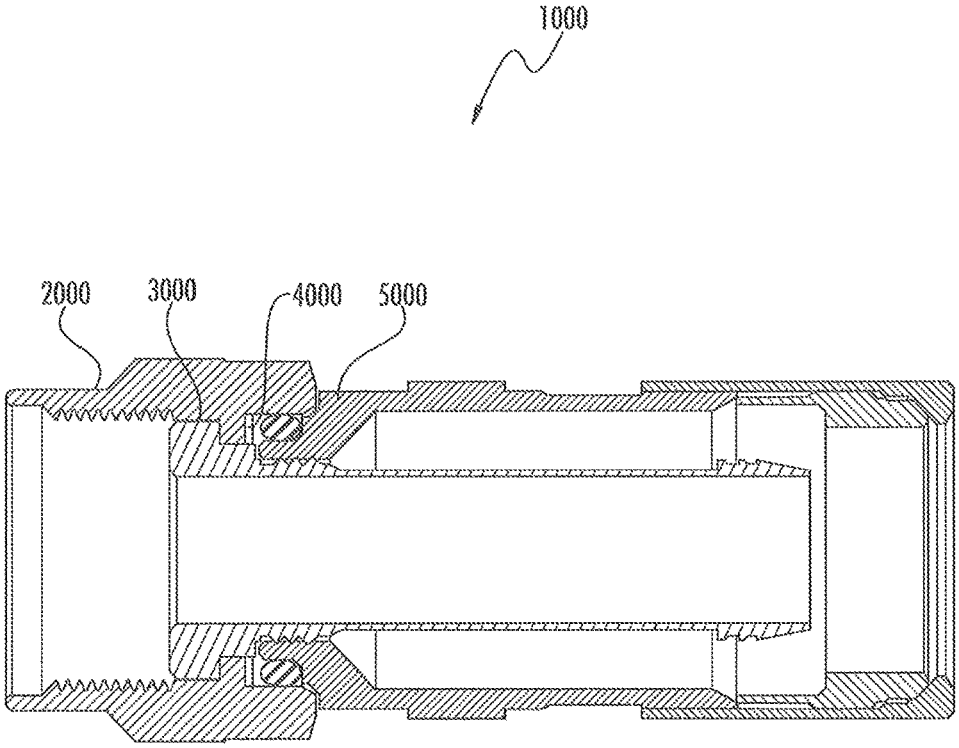
FIG. 1 (PRIOR ART)
FIG. 1 is a side cross sectional view of a coaxial cable connector in the prior art.

Reference will now be made in detail to the embodiments, examples of which are illustrated in the accompanying drawings, in which some, but not all embodiments are shown. Indeed, the concepts may be embodied in many different forms and should not be construed as limiting herein. Rather, these embodiments are provided so that this disclosure will satisfy applicable legal requirements. Whenever possible, like reference numbers will be used to refer to like components or parts.

Coaxial cable connectors are used to couple a prepared end of a coaxial cable to a threaded female equipment connection port of an appliance. The coaxial cable connector may have a post, a moveable post or be postless. In each case though, in addition to providing an electrical and mechanical connection between the conductor of the coaxial connector and the conductor of the female equipment connection port, the coaxial cable connector provides a ground path from an outer conductor of the coaxial cable to the equipment connection port. The outer conductor may be, as examples, a conductive foil or a braided sheath. Maintaining a stable ground path protects against the ingress of undesired radio frequency ("RF") signals which may degrade performance of the appliance. This is especially applicable when the coaxial cable connector is not fully tightened to the equipment connection port, either due to not being tightened upon initial installation or due to becoming loose after installation.

Embodiments disclosed herein include a coaxial cable connector having an inner conductor, a dielectric surrounding the inner conductor, an outer conductor surrounding the dielectric, and a jacket surrounding the outer conductor and used for coupling an end of a coaxial cable to an equipment connection port. The coaxial cable comprises a coupler, a body and a post. The coupler is adapted to couple the connector to the equipment connection port. The coupler has a step and a threaded portion adapted to connect with a threaded portion of the equipment connection port. At least one thread on the coupler has a pitch angle different than a pitch angle of at least one thread of the equipment connection port. The body is assembled with the coupler. The post is assembled with the coupler and the body and is adapted to receive an end of a coaxial cable. The post comprises a flange, a contacting portion and a shoulder. The contacting portion is integral and monolithic with at least a portion of the post.

A first circuitous path is established by the a step, the flange, the contacting portion and the shoulder. A second circuitous path is established by the threaded portion of the coupler and the threaded portion of the equipment connection port. The first circuitous path and the second circuitous path provide for RF shielding of the assembled coaxial cable connector wherein RF signals external to the coaxial cable connector are attenuated by at least about 50 dB in a range up to about 1000 MHz, and the integrity of an electrical signal transmitted through coaxial cable connector is maintained regardless of the tightness of the coupling of the connector to the equipment connection port. A transfer impedance averages about 0.24 ohms. Additionally, the pitch angle of the thread of the coupler may be about 2 degrees different than the pitch angle of the thread of the equipment connection port. As a non-limiting example, the pitch angle of the thread of the coupler may be about 62 degrees, and the pitch angle of the thread of the equipment connection port is about 60 degrees.

For purposes of this description, the term "forward" will be used to refer to a direction toward the portion of the coaxial cable connector that attaches to a terminal, such as an appliance equipment port. The term "rearward" will be used to refer to a direction that is toward the portion of the coaxial cable connector that receives the coaxial cable. The term "terminal" will be used to refer to any type of connection medium to which the coaxial cable connector may be coupled, as examples, an appliance equipment port, any other type of connection port, or an intermediate termination device. Additionally, for purposes herein, electrical continuity shall mean DC contact resistance from the outer conductor of the coaxial cable to the equipment port of less than about 3000 milliohms. Accordingly, a DC contact resistance of more than about 3000 milliohms shall be considered as indicating electrical discontinuity or an open in the path between the outer conductor of the coaxial cable and the equipment port.

Figure 2:
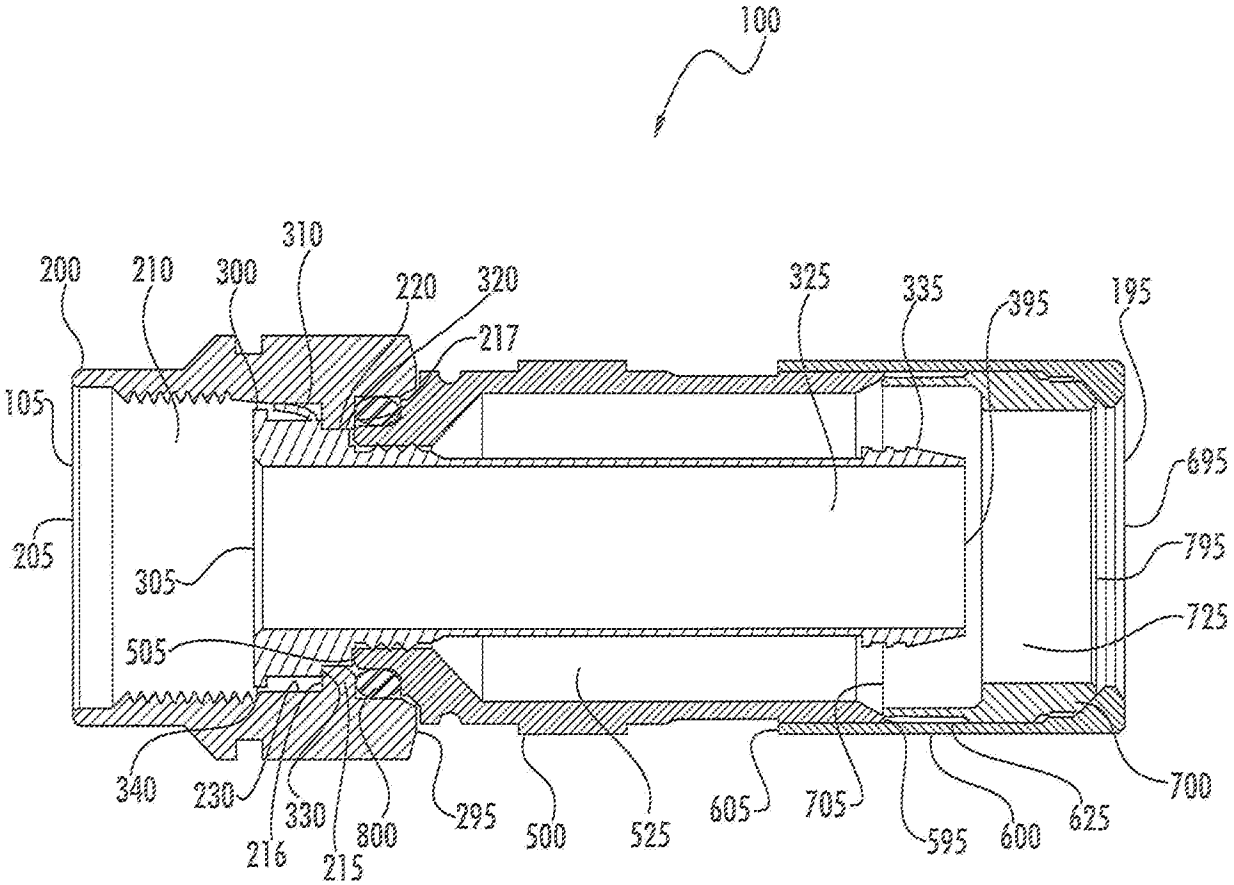
FIG. 2 is a side, cross sectional view of an exemplary embodiment of a coaxial connector comprising a post with a contacting portion providing an integral RFI and grounding shield.

Referring now to FIG. 2, there is illustrated an exemplary embodiment of a coaxial cable connector 100. The coaxial cable connector 100 has a front end 105, a back end 195, a coupler 200, a post 300, a body 500, a shell 600 and a gripping member 700. The coupler 200 at least partially comprises a front end 205, a back end 295, a central passage 210, a lip 215 with a forward facing surface 216 and a rearward facing surface 217, a through-bore 220 formed by the lip 215, and a bore 230. Coupler 200 is preferably made of metal such as brass and plated with a conductive material such as nickel. Alternately or additionally, selected surfaces of the coupler 200 may be coated with conductive or non-conductive coatings or lubricants, or a combinations thereof. Post 300, may be tubular, at least partially comprises a front end 305, a back end 395, and a contacting portion 310. In FIG. 2, Contacting portion 310 is shown as a protrusion integrally formed and monolithic with post 300. Contacting portion 310 may, but does not have to be, radially projecting. Post 300 may also comprise an enlarged shoulder 340, a collar portion 320, a through-bore 325, a rearward facing annular surface 330, and a barbed portion 335 proximate the back end 395. The post 300 is preferably made of metal such as brass and plated with a conductive material such as tin. Additionally, the material, in an exemplary embodiment, may have a suitable spring characteristic permitting contacting portion 310 to be flexible, as described below. Alternately or additionally, selected surfaces of post 300 may be coated with conductive or non-conductive coatings or lubricants or a combination thereof. Contacting portion 310, as noted above, is monolithic with post 300 and provides for electrical continuity through the connector 100 to an equipment port (not shown in FIG. 2) to which connector 100 may be coupled. In this manner, post 300 provides for a stable ground path through the connector 100, and, thereby, electromagnetic shielding to protect against the ingress and egress of RF signals. Body 500 at least partially comprises a front end 505, a back end 595, and a central passage 525. Body 500 is preferably made of metal such as brass and plated with a conductive material such as nickel. Shell 600 at least partially comprises a front end 605, a back end 695, and a central passage 625. Shell 600 is preferably made of metal such as brass and plated with a conductive material such as nickel. Gripping member 700 at least partially comprises a front end 705, a back end 795, and a central passage 725. Gripping member 700 is preferably made of a suitable polymer material such as acetal or nylon. The resin can be selected from thermoplastics characterized by good fatigue life, low moisture sensitivity, high resistance to solvents and chemicals, and good electrical properties.

In FIG. 2, coaxial cable connector 100 is shown in an unattached, uncompressed state, without a coaxial cable inserted therein. Coaxial cable connector 100 couples a prepared end of a coaxial cable to a terminal, such as a threaded female equipment appliance connection port (not shown in FIG. 2). This will be discussed in more detail with reference to FIG. 18A. Shell 600 slideably attaches to body 500 at back end 595 of body 500. Coupler 200 attaches to coaxial cable connector 100 at back end 295 of coupler 200. Coupler 200 may rotatably attach to front end 305 of post 300 while engaging body 500 by means of a press-fit. Front end 305 of post 300 positions in central passage 210 of coupler 200 and has a back end 395 which is adapted to extend into a coaxial cable. Proximate back end 395, post 300 has a barbed portion 335 extending radially outwardly from post 300. An enlarged shoulder 340 at front end 305 extends inside the coupler 200. Enlarged shoulder 340 comprises a collar portion 320 and a rearward facing annular surface 330. Collar portion 320 allows coupler 200 to rotate by means of a clearance fit with through-bore 220 of coupler 200. Rearward facing annular surface 330 limits forward axial movement of the coupler 200 by engaging forward facing surface 216 of lip 215. Coaxial cable connector 100 may also include a sealing ring 800 seated within coupler 200 to form a seal between coupler 200 and body 500.

Contacting portion 310 may be monolithic with or a unitized portion of post 300. As such, contacting portion 310 and post 300 or a portion of post 300 may be constructed from a single piece of material. The contacting portion 310 may contact coupler 200 at a position that is forward of forward facing surface 216 of lip 215. In this way, contacting portion 310 of post 300 provides an electrically conductive path between post 300, coupler 200 and body 500. This enables an electrically conductive path from coaxial cable through coaxial cable connector 100 to terminal providing an electrical ground and a shield against RF ingress and egress. Contacting portion 310 is formable such that as the coaxial cable connector 100 is assembled, contacting portion 310 may form to a contour of coupler 200. In other words, coupler 200 forms or shapes contacting portion 310 of post 300. The forming and shaping of the contacting portion 310 may have certain elastic/plastic properties based on the material of contacting portion 310. Contacting portion 310 deforms, upon assembly of the components of coaxial cable connector 100, or, alternatively contacting portion 310 of post 300 may be pre-formed, or partially preformed to electrically contactedly fit with coupler 200 as explained in greater detail with reference to FIG. 4A through FIG. 4D, below. In this manner, post 300 is secured within coaxial cable connector 100, and contacting portion 310 establishes an electrically conductive path between body 500 and coupler 200. Further, the electrically conductive path remains established regardless of the tightness of the coaxial cable connector 100 on the terminal due to the elastic/plastic properties of contacting portion 310. This is due to contacting portion 310 maintaining mechanical and electrical contact between components, in this case, post 300 and coupler 200, notwithstanding the size of any interstice between the components of the coaxial cable connector 100. In other words, contacting portion 310 is integral to and maintains the electrically conductive path established between post 300 and coupler 200 even when the coaxial cable connector 100 is loosened and/or partially disconnected from the terminal, provided there is some contact of coupler 200 with equipment port. Although coaxial connector 100 in FIG. 2 is an axial-compression type coaxial connector having a post 300, contacting portion 310 may be integral to and monolithic with any type of coaxial cable connector and any other component of a coaxial cable connector, examples of which will be discussed herein with reference to the embodiments. However, in all such exemplary embodiments, contacting portion 310 provides for electrical continuity from an outer conductor of a coaxial cable received by coaxial cable connector 100 through coaxial cable connector 100 to a terminal, without the need for a separate component. Additionally, the contacting portion 310 provides for electrical continuity regardless of how tight or loose the coupler is to the terminal. In other words, contacting portion 310 provides for electrical continuity from the outer conductor of the coaxial cable to the terminal regardless and/or irrespective of the tightness or adequacy of the coupling of the coaxial cable connector 100 to the terminal. It is only necessary that the coupler 200 be in contact with the terminal.

Figure 3A:
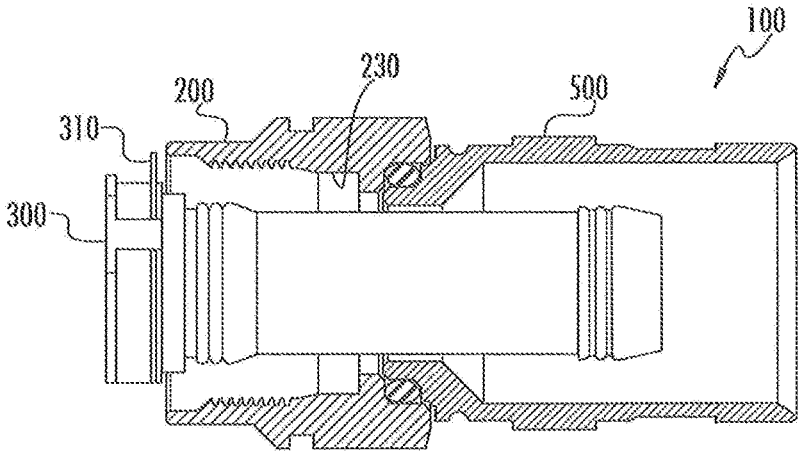
FIG. 3A is side, cross-sectional view of the coaxial cable connector of FIG. 2 in a state of partial assembly.
Figure 3B:
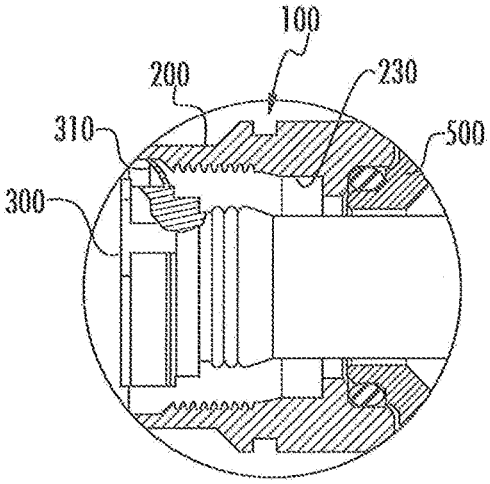
FIG. 3B is a partial, cross-sectional detail view of the post of the coaxial cable connector of FIG. 2 in a state of further assembly than as illustrated in FIG. 3A, and illustrating the contacting portion of the post beginning to form to a contour of the coupler.
Figure 3C:
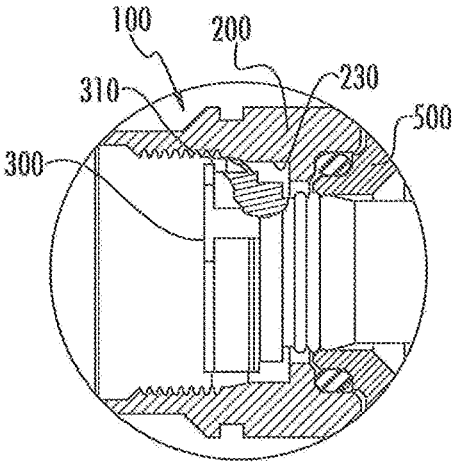
FIG. 3C is a partial, cross-sectional detail view of the post of the coaxial cable connector of FIG. 2 in a state of further assembly than as illustrated in FIGS. 3A and 3B, and illustrating the contacting portion of the post continuing to form to a contour of the coupler.
Figure 3D:
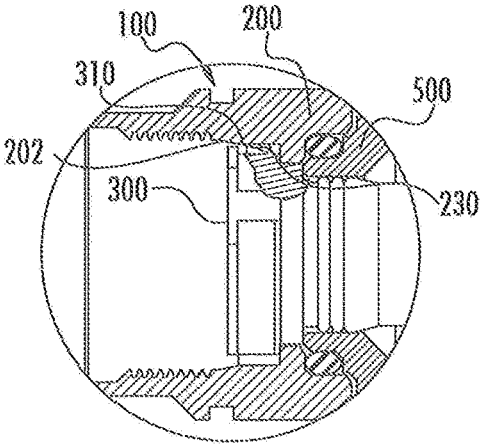
FIG. 3D is a partial, cross-sectional detail view of the post of the coaxial cable connector of FIG. 2 in a state of further assembly than as illustrated in FIGS. 3A, 3B and 3C and illustrating the contacting portion of the post forming to a contour of the coupler.

Referring now to FIGS. 3A, 3B 3C and 3D, post 300 is illustrated in different states of assembly with coupler 200 and body 500. In FIG. 3A, post 300 is illustrated partially assembled with coupler 200 and body 500 with contacting portion 310 of post 300, shown as a protrusion, outside and forward of coupler 200. Contacting portion 310 may, but does not have to be, radially projecting. In FIG. 3B, contacting portion 310 has begun to advance into coupler 200 and contacting portion 310 is beginning to form to a contour of coupler 200. As illustrated in FIG. 3B, contacting portion 310 is forming to an arcuate or, at least, a partially arcuate shape. As post 300 is further advanced into coupler 200 as shown in FIG. 3C, contacting portion 310 continues to form to the contour of coupler 200. When assembled as shown in FIG. 3D, contacting portion 310 is forming to the contour of coupler 200 and is contactedly engaged with bore 230 accommodating tolerance variations with bore 230. In FIG. 3D coupler 200 has a face portion 202 that tapers. The face portion 202 guides the contacting portion 310 to its formed state during assembly in a manner that does not compromise its structural integrity, and, thereby, its elastic/plastic property. Face portion 202 may be or have other structural features, as a non-limiting example, a curved edge, to guide the contacting portion 310. The flexible or resilient nature of the contacting portion 310 in the formed state as described above, permits coupler 200 to be easily rotated and yet maintain a reliable electrically conductive path. It should be understood, that contacting portion 310 is formable and, as such, may exist in an unformed and a formed state based on the elastic/plastic property of the material of contacting portion 310. As the coaxial cable connector 100 assembles contacting portion 310 transition from an unformed state to a formed state.

Figure 4A:
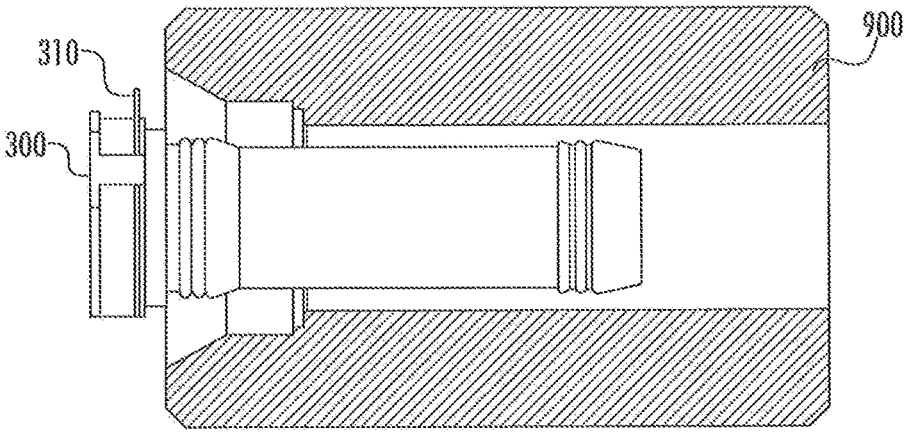
FIG. 4A is a partial, cross-sectional view of the post of the coaxial cable connector of FIG. 2 in which the post is partially inserted into a forming tool.
Figure 4B:
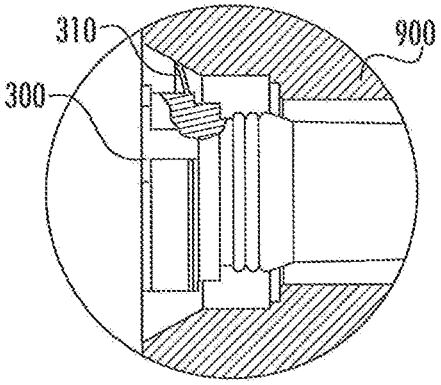
FIG. 4B is a partial, cross-sectional detail view of the post of the coaxial cable connector of FIG. 2 in which the post is inserted into the forming tool further than as illustrated in FIG. 4A using a forming tool and illustrating the contacting portion of the post beginning to form to a contour of the forming tool.
Figure 4C:
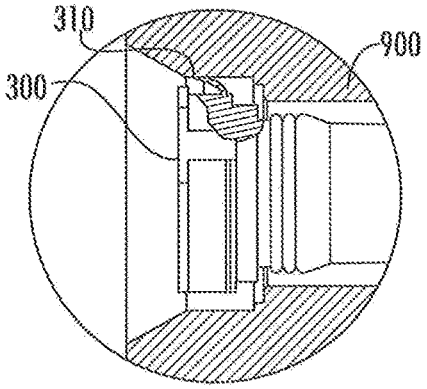
FIG. 4C is a partial cross-sectional detail view of the post of the coaxial cable connector of FIG. 2 in which the post is inserted into the forming tool further than as illustrated in FIGS. 4A and 4B illustrating the contacting portion of the post continuing to form to the contour of the forming tool.
Figure 4D:
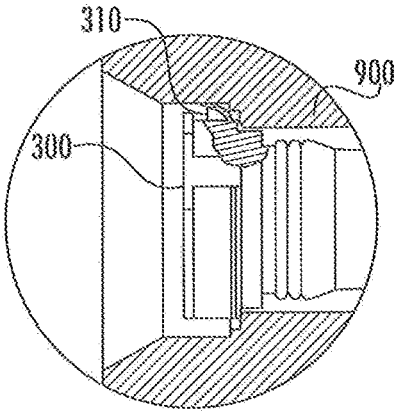
FIG. 4D is a partial cross-sectional detail view of the post of the coaxial cable connector of FIG. 2 in which the post is fully inserted into the forming tool and illustrating the contacting portion of the post forming to the contour of the forming tool.
Figure 5B:
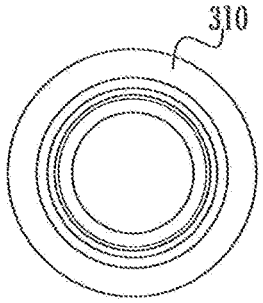
FIGS. 5A through 5H are front and side schematic views of exemplary embodiments of the contacting portions of the post.
Figure 5A:
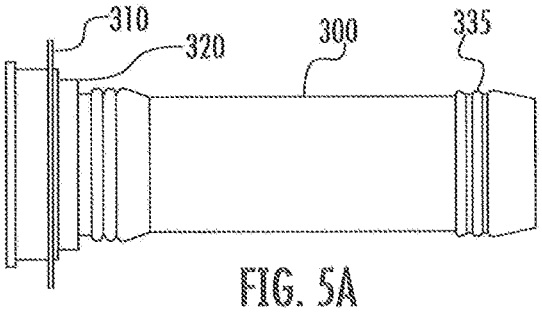
Figure 5D:
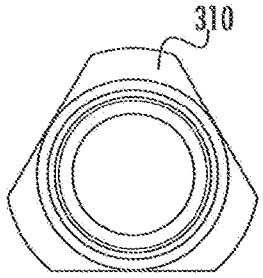
Figure 5C:
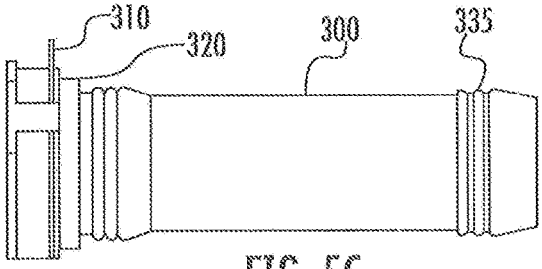
Figure 5F:
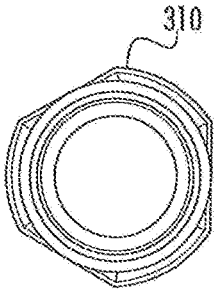
Figure 5E:
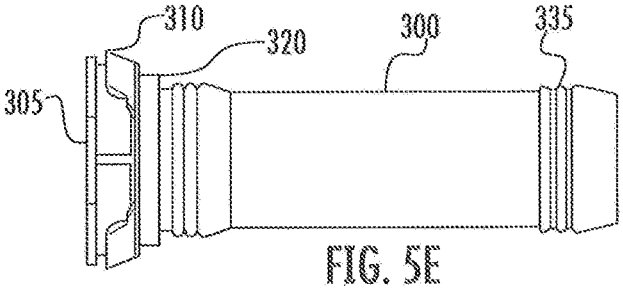
Figure 5H:
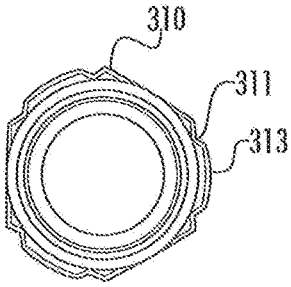
Figure 5G:
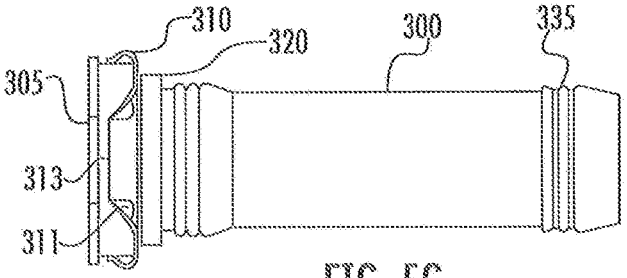

Referring now to FIGS. 4A, 4B, 4C and 4D the post 300 is illustrated in different states of insertion into a forming tool 900. In FIG. 4A, post 300 is illustrated partially inserted in forming tool 900 with contacting portion 310 of post 300 shown as a protrusion. Protrusion may, but does not have to be radially projecting. In FIG. 4B, contacting portion 310 has begun to advance into forming tool 900. As contacting portion 310 is advanced into forming tool 900, contact portion 310 begins flexibly forming to a contour of the interior of forming tool 900. As illustrated in FIG. 4B, contacting portion 310 is forming to an arcuate or, at least, a partially arcuate shape. As post 300 is further advanced into forming tool 900 as shown in FIG. 4C, contacting portion 310 continues forming to the contour of the interior of forming tool 900. At a final stage of insertion as shown in FIG. 4C contacting portion 310 is fully formed to the contour of forming tool 900, and has experienced deformation in the forming process but retains spring or resilient characteristics based on the elastic/plastic property of the material of contacting portion 310. Upon completion or partial completion of the forming of contacting portion 310, post 300 is removed from forming tool 900 and may be subsequently installed in the connector 100 or other types of coaxial cable connectors. This manner of forming or shaping contacting portion 310 to the contour of forming tool 900 may be useful to aid in handling of post 300 in subsequent manufacturing processes, such as plating for example. Additionally, use of this method makes it possible to achieve various configurations of contacting portion 310 formation as illustrated in FIGS. 5A through 5H. FIG. 5A is a side schematic view of an exemplary embodiment of post 300 where contacting portion 310 is a radially projecting protrusion that completely circumscribes post 300. In this view, contacting portion 310 is formable but has not yet been formed to reflect a contour of coaxial cable connector or forming tool. FIG. 5B is a front schematic view of the post 300 of FIG. 5. FIG. 5C is a side schematic view of an exemplary embodiment of post 300 where contacting portion 310 has a multi-cornered configuration. Contacting portion 310 may be a protrusion and may, but does not have to be, radially projecting. Although in FIG. 5C contacting portion 310 is shown as tri-cornered, contacting portion 310 can have any number of corner configurations, as non-limiting examples, two, three, four, or more. In FIG. 5C, contacting portion 310 may be formable but has not yet been formed to reflect a contour of coaxial cable connector or forming tool. FIG. 5D is a front schematic view of post 300 of FIG. 5C. FIG. 5E is a side schematic view of post 300 where contacting portion 310 has a tri-cornered configuration. In this view, contacting portion 310 is shown as being formed to a shape in which contacting portion 310 cants or slants toward the front end 305 of post 300. FIG. 5F is a front schematic view of post 300 of FIG. 5E. FIG. 5G is a side schematic view of an exemplary embodiment of post 300 where contacting portion 310 has a tri-cornered configuration. In this view contacting portion 310 is formed in a manner differing from FIG. 5E in that indentations 311 in contacting portion 310 result in a segmented or reduced arcuate shape 313. FIG. 5H is a front schematic view of post 300 of FIG. 5G.

It will be apparent to those skilled in the art that contacting portion 310 as illustrated in FIGS. 2-5H may be integral to and monolithic with post 300. Additionally, contacting portion 310 may have or be any shape, including shapes that may be flush or aligned with other portions of post 300, or may have any number of configurations, as non-limiting examples, configurations ranging from completely circular to multi-cornered geometries, and still perform its function of providing electrical continuity. Further, contacting portion 310 may be formable and formed to any shape or in any direction.

Figure 6:
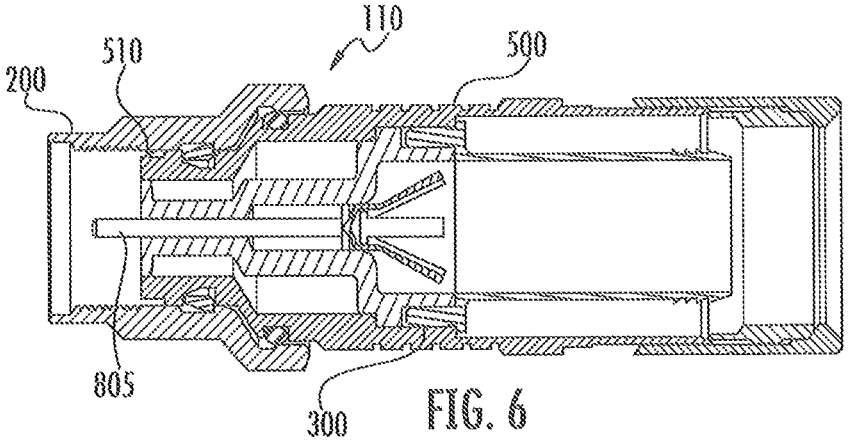
FIG. 6 is a cross-sectional view of an exemplary embodiment of a coaxial cable connector comprising an integral pin, in the state of assembly with body having a contacting portion forming to a contour of the coupler.
Figure 6A:
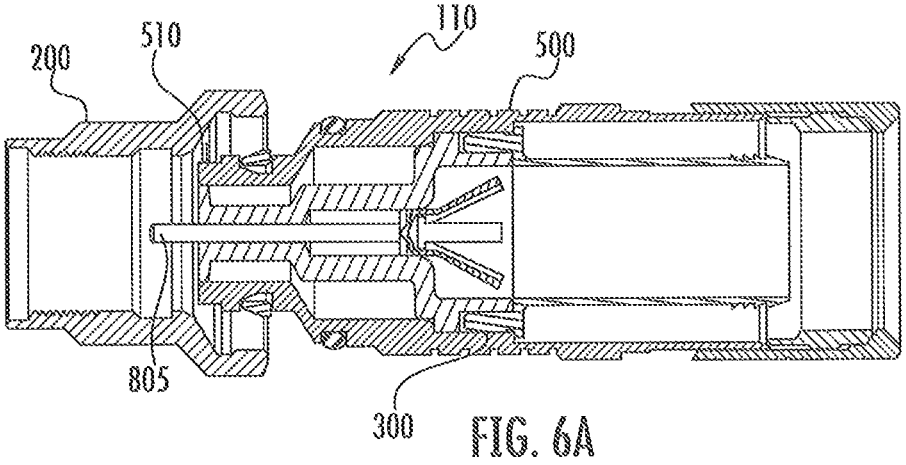
FIG. 6A is a cross-sectional view of the coaxial cable connector illustrated in FIG. 6 in a partial state of assembly illustrating the contacting portion of the body and adapted to form to a contour of the coupler.

FIG. 6 is a cross-sectional view of an exemplary embodiment of a coaxial cable connector 110 comprising an integral pin 805, wherein coupler 200 rotates about body 500 instead of post 300 and contacting portion 510 is a protrusion from, integral to and monolithic with body 500 instead of post 300. In this regard, contacting portion 510 may be a unitized portion of body 500. As such, contacting portion 510 may be constructed with body 500 or a portion of body 500 from a single piece of material. Coaxial cable connector 110 is configured to accept a coaxial cable. Contacting portion 510 may be formed to a contour of coupler 200 as coupler 200 is assembled with body 500 as illustrated in FIG. 6A. FIG. 6A is a cross-sectional view of an exemplary embodiment of a coaxial cable connector 110 in a state of partial assembly.

Contacting portion 510 has not been formed to a contour of the coupler 200. Assembling the coupler 200 with the body 500 forms the contacting portion 510 in a rearward facing manner as opposed to a forward facing manner as is illustrated with the contacting portion 310. However, as with contacting portion 310, the material of contacting portion 510 has certain elastic/plastic property which, as contacting portion 510 is formed provides that contacting portion 510 will press against the contour of the coupler 200 and maintain mechanical and electrical contact with coupler 200. Contacting portion 510 provides for electrical continuity from the outer conductor of the coaxial cable to the terminal regardless of the tightness or adequacy of the coupling of the coaxial cable connector 100 to the terminal, and regardless of the tightness of the coaxial cable connector 100 on the terminal in the same way as previously described with respect to contacting portion 310. Additionally or alternatively, contacting portion 310 may be cantilevered or attached at only one end of a segment.

Figure 7:
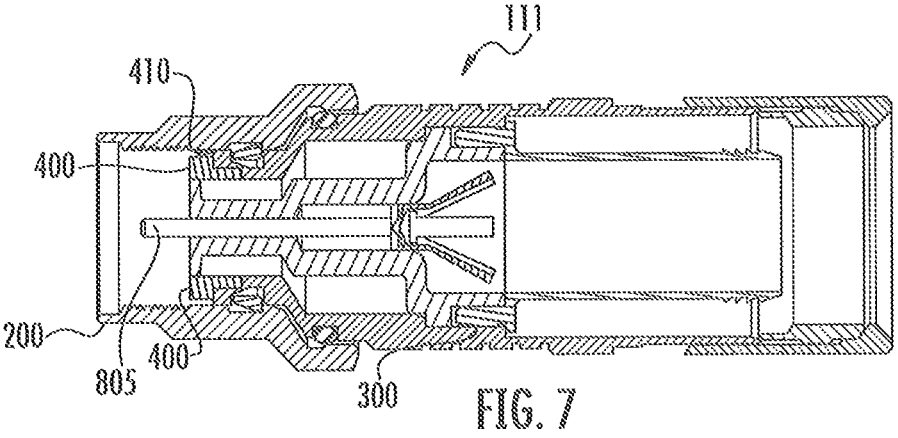
FIG. 7 is a cross-sectional view of an exemplary embodiment of a coaxial cable connector comprising an integral pin, wherein the coupler rotates about a body instead of a post and the contacting portion is part of a component press fit into the body and forming to a contour of the coupler.

FIG. 7 is a cross-sectional view of an exemplary embodiment of a coaxial cable connector 111 comprising an integral pin 805, and a conductive component 400. Coupler 200 rotates about body 500 instead of about a post, which is not present in coaxial cable connector 111. Contacting portion 410 is shown as a protrusion and may be integral to, monolithically with and radially projecting from a conductive component 400 which is press fit into body 500. Contacting portion 410 may be a unitized portion of conductive component 400. As such, the contacting portion 410 may be constructed from a single piece of material with conductive component 400 or a portion of conductive component 400. As with contacting portion 310, the material of contacting portion 410 has certain elastic/plastic property which, as contacting portion 410 is formed provides that contacting portion 410 will press against the contour of the coupler 200 and maintain mechanical and electrical contact with coupler 200 as conductive component 400 inserts in coupler 200 when assembling body 500 with coupler 200 as previously described.

Figure 8:
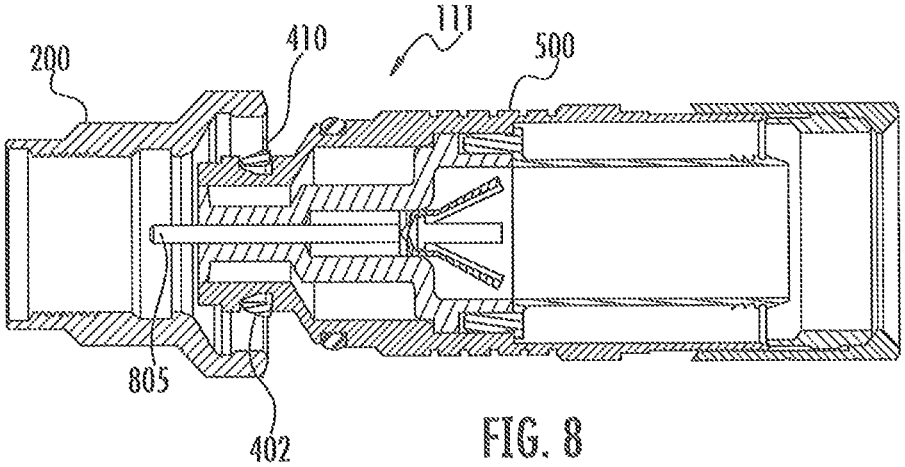
FIG. 8 is a cross-sectional view of an exemplary embodiment of a coaxial cable connector in a partial state of assembly and comprising an integral pin, wherein the coupler rotates about a body instead of a post and the contacting portion is part of a component press position in the body and forming to a contour of the coupler.
Figure 8A:
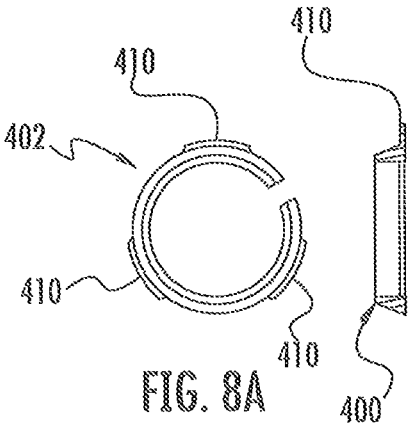
FIG. 8A is a front and side detail view of the component having the contacting portion of the coaxial cable connector of FIG. 8.

FIG. 8 is a cross-sectional view of another exemplary embodiment of the coaxial cable connector 111 comprising an integral pin 805, and a retaining ring 402. The coupler 200 rotates about body 500 instead of a post. Contacting portion 410 may be integral with and radially projecting from a retaining ring 402 which fits into a groove formed in body 500. The contacting portion 410 may be a unitized portion of the retaining ring 402. As such, the contacting portion 410 may be constructed from a single piece of material with the retaining ring 402 or a portion of the retaining ring 402. In this regard, FIG. 8A illustrates front and side views of the retaining ring 402. In FIG. 8A, contacting portion 410 is shown as three protrusions integral with and radially projecting from retaining ring 402. As discussed above, the material of contacting portion 410 has certain elastic/plastic property which, as contacting portion 410 is formed provides that contacting portion 410 will press against the contour of the coupler 200 and maintain mechanical and electrical contact with coupler 200 as retaining ring 402 inserts in coupler 200 when assembling body 500 with coupler 200 as previously described.

It will be apparent to those skilled in the art that the contacting portion 410 as illustrated in FIGS. 6-8A may be integral to the body 500 or may be attached to or be part of another component 400, 402. Additionally, the contacting portion 410 may have or be any shape, including shapes that may be flush or aligned with other portions of the body 500 and/or another component 400, 402, or may have any number of configurations, as non-limiting examples, configurations ranging from completely circular to multi-cornered geometries.

Figure 9:
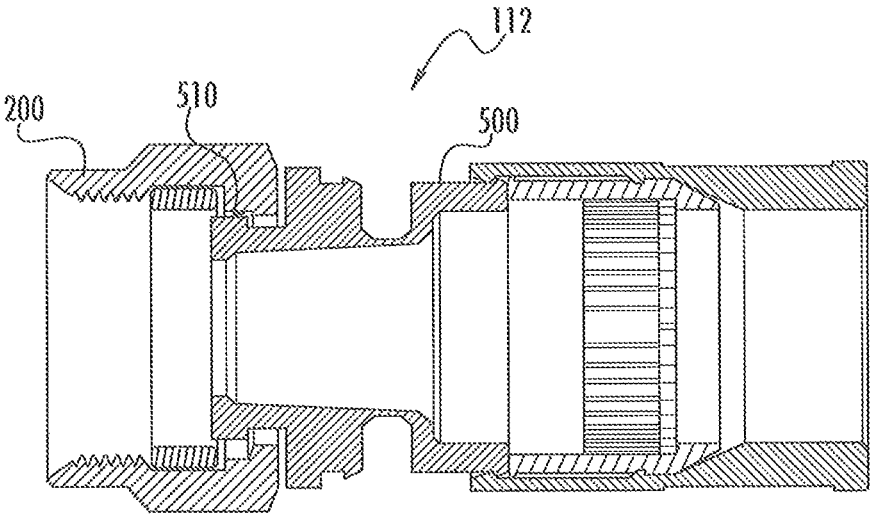
FIG. 9 is a cross sectional view of an exemplary embodiment of a coaxial cable connector comprising a post-less configuration, and a body having a contacting portion forming to a contour of the coupler.

FIG. 9 is a cross-sectional view of an embodiment of a coaxial cable connector 112 that is a compression type of connector with no post. In other words, having a post-less configuration. The coupler 200 rotates about body 500 instead of a post. The body 500 comprises contacting portion 510. The contacting portion 510 is integral with the body 500. As such, the contacting portion 510 may be constructed from a single piece of material with the body 500 or a portion of the body 500. The contacting portion 510 forms to a contour of the coupler 200 when the coupler 200 is assembled with the body 500.

Figure 10:
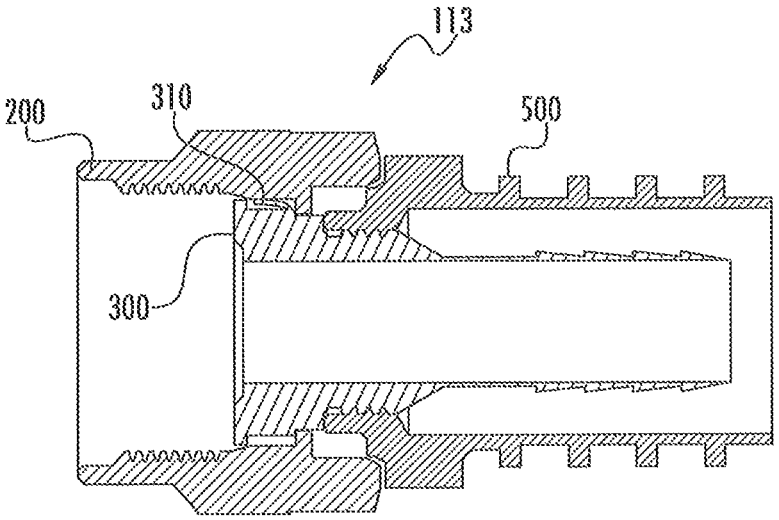
FIG. 10 is a cross sectional view of an exemplary embodiment of a coaxial cable connector comprising a hex crimp body and a post having a contacting portion forming to a contour of the coupler.

FIG. 10 is a cross-sectional view of an embodiment of a coaxial cable connector 113 that is a hex-crimp type connector. The coaxial cable connector 113 comprises a coupler 200, a post 300 with a contacting portion 310 and a body 500. The contacting portion 310 is integral to and monolithic with post 300. Contacting portion 310 may be unitized with post 300. As such, contacting portion 310 may be constructed from a single piece of material with post 300 or a portion of post 300. Contacting portion 310 forms to a contour of coupler 200 when coupler 200 is assembled with body 500 and post 300. The coaxial cable connector 113 attaches to a coaxial cable by means radially compressing body 500 with a tool or tools known in the industry.

Figure 11:
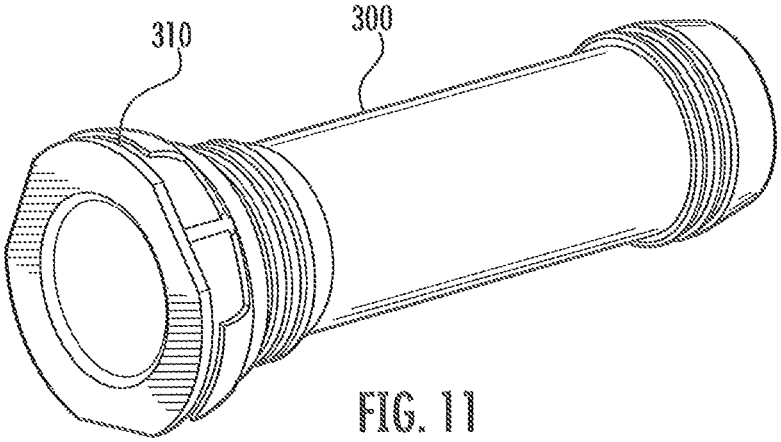
FIG. 11 is an isometric, schematic view of the post of the coaxial cable connector of FIG. 2 wherein the post has a contacting portion in a formed state.

FIG. 11 is an isometric schematic view of post 300 of coaxial cable connector 100 in FIG. 2 with the contacting portion 310 formed to a position of a contour of a coupler (not shown).

Figure 12:
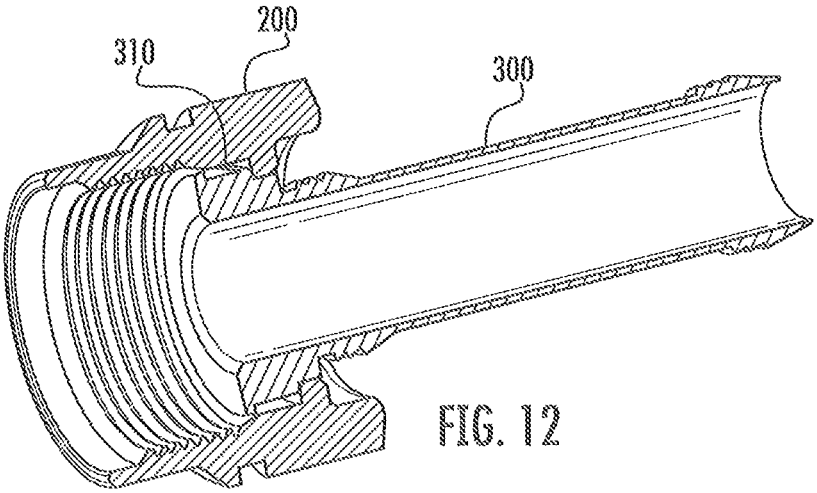
FIG. 12 is an isometric, cross-sectional view of the post and the coupler of the coaxial cable connector of FIG. 2 illustrating the contacting portion of the post forming to a contour of the coupler.

FIG. 12 is an isometric cross sectional view of post 300 and coupler 200 of connector 100 in FIG. 2 illustrated assembled with the post 300. The contacting portion 310 is formed to a contour of the coupler 200.

Figure 13:
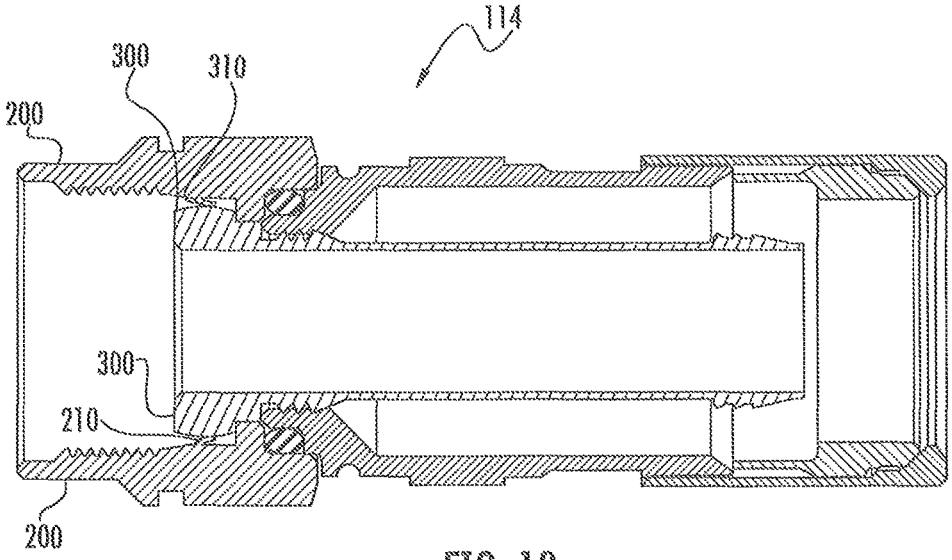
FIG. 13 is a cross-sectional view of an exemplary embodiment of a coaxial cable connector having a coupler with a contacting portion forming to a contour of the post.

FIG. 13 is a cross-sectional view of an embodiment of a coaxial cable connector 114 comprising a post 300 and a coupler 200 having a contacting portion 210. Contacting portion 210 is shown as an inwardly directed protrusion. Contacting portion 210 is integral to and monolithic with coupler 200 and forms to a contour of post 300 when post 300 assembles with coupler 200. Contacting portion 210 may be unitized with coupler 200. As such, contacting portion 210 may be constructed from a single piece of material with coupler 200 or a portion of coupler 200. Contacting portion 210 provides for electrical continuity from the outer conductor of the coaxial cable to the terminal regardless of the tightness or adequacy of the coupling of the coaxial cable connector 114 to the terminal, and regardless of the tightness of coaxial cable connector 114 on the terminal.

Contacting portion 210 may have or be any shape, including shapes that may be flush or aligned with other portions of coupler 200, or may have and/or be formed to any number of configurations, as non-limiting examples, configurations ranging from completely circular to multi-cornered geometries.

Figure 14:
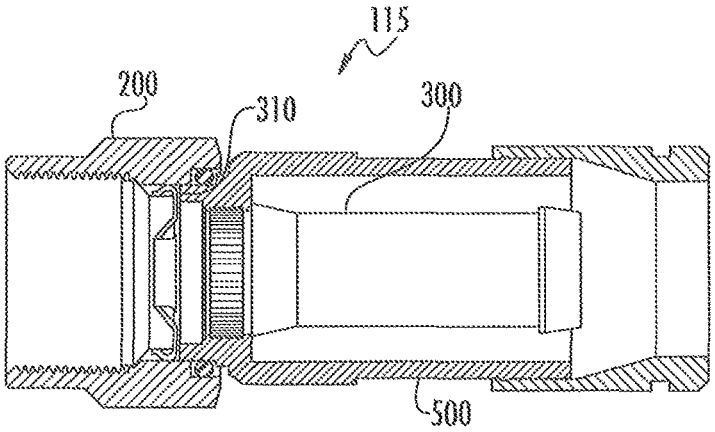
FIG. 14 is a cross-sectional view of an exemplary embodiment of a coaxial cable connector having a post with a contacting portion forming to a contour of the coupler.
Figure 15:
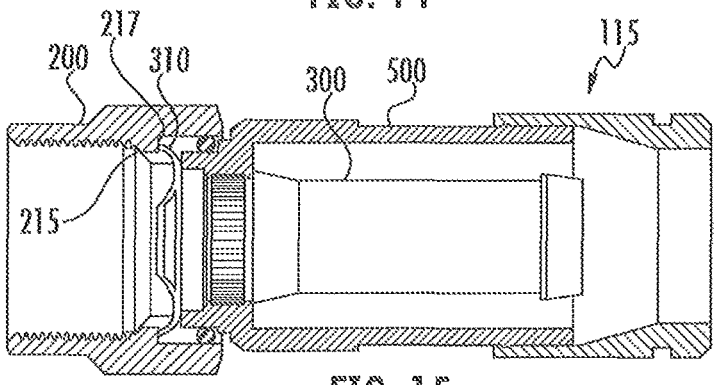
FIG. 15 is a cross-sectional view of an exemplary embodiment of a coaxial cable connector having a post with a contacting portion forming to a contour behind a lip in the coupler toward the rear of the coaxial cable connector.
Figure 16:
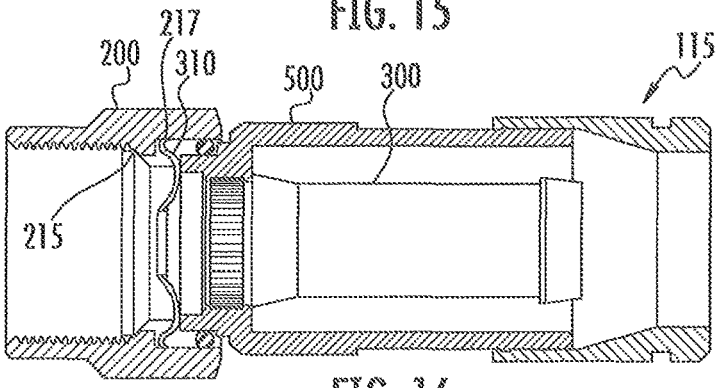
FIG. 16 is a cross-sectional view of an exemplary embodiment of a coaxial cable connector having a post with a contacting portion forming to a contour behind a lip in the coupler toward the rear of the coaxial cable connector.

FIGS. 14, 15 and 16 are cross-sectional views of embodiments of coaxial cable connectors 115 with a post similar to post 300 comprising a contacting portion 310 as described above such that the contacting portion 310 is shown as outwardly radially projecting, which forms to a contour of the coupler 200 at different locations of the coupler 200. Additionally, the contacting portion 310 may contact the coupler 200 rearward of the lip 215, for example as shown in FIGS. 15 and 16, which may be at the rearward facing surface 217 of the lip 215, for example as shown in FIG. 15.

Figure 17:
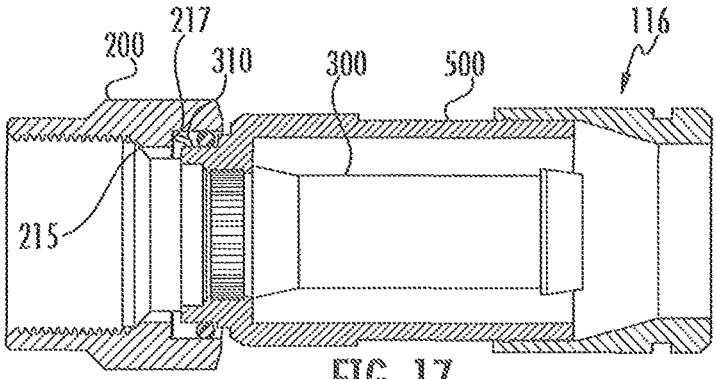
FIG. 17 is a cross-sectional view of an exemplary embodiment of a coaxial cable connector having a body with a contacting portion forming to a contour behind a lip in the coupler toward the rear of the coaxial cable connector.

FIG. 17 is a cross-sectional view of an embodiment of a coaxial cable connector 116 with a body 500 comprising a contacting portion 310, wherein the contacting portion 310 is shown as an outwardly directed protrusion from body 500 that forms to the coupler 200.

Figure 18:
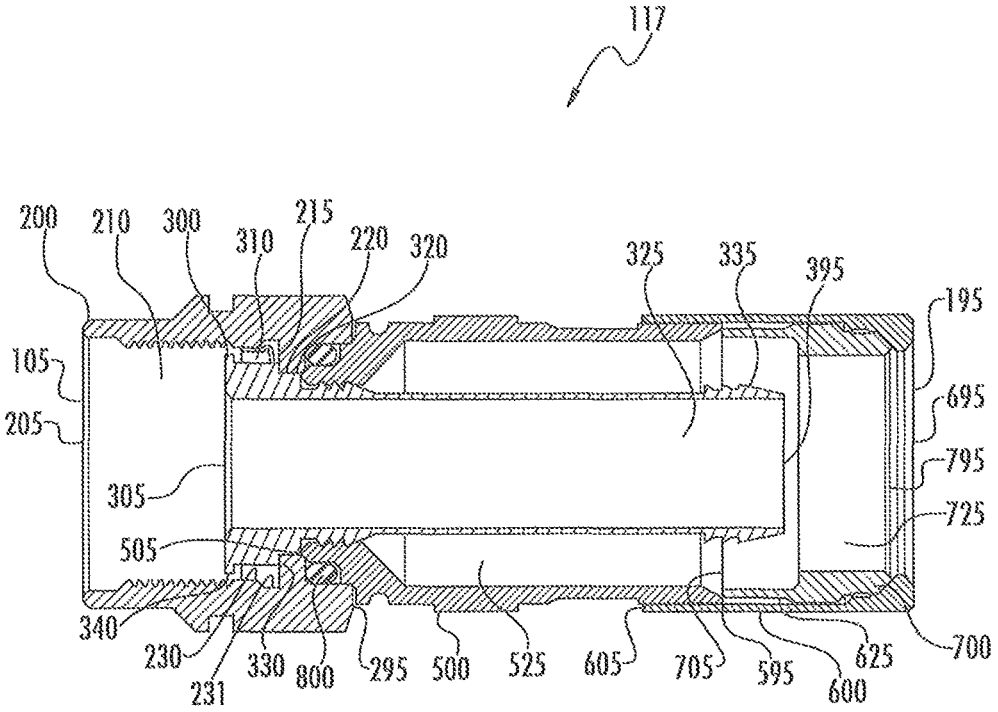
FIG. 18 is a cross-sectional view of an exemplary embodiment of a coaxial cable connector having a post with a contacting portion forming to a contour of a coupler with an undercut.
Figure 18A:
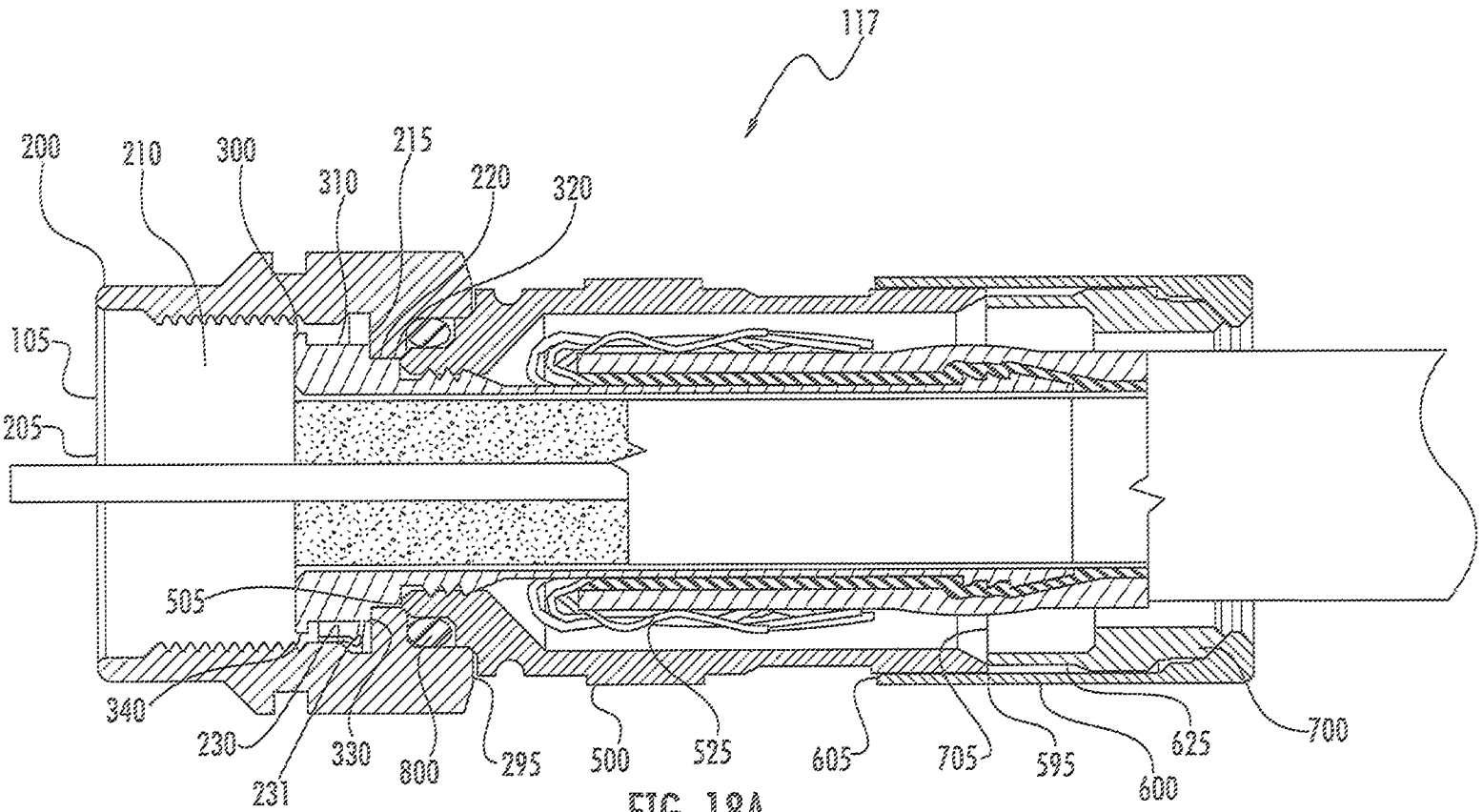
FIG. 18A is a partial, cross-sectional view of an exemplary embodiment of a coaxial cable connector having a post with a contacting portion forming to a contour of a coupler with an undercut having a prepared coaxial cable inserted in the coaxial cable connector.

FIG. 18 is a cross-sectional view of an embodiment of a coaxial cable connector 117 having a post 300 with an integral contacting portion 310 and a coupler 200 with an undercut 231. The contacting portion 310 is shown as a protrusion that forms to the contours of coupler 200 at the position of undercut 231. FIG. 18A is a cross-sectional view of the coaxial cable connector 117 as shown in FIG. 18 having a prepared coaxial cable inserted in the coaxial cable connector 117. The body 500 and the post 300 receive the coaxial cable (FIG. 18A). The post 300 at the back end 395 is inserted between an outer conductor and a dielectric layer of the coaxial cable.

Figure 19:
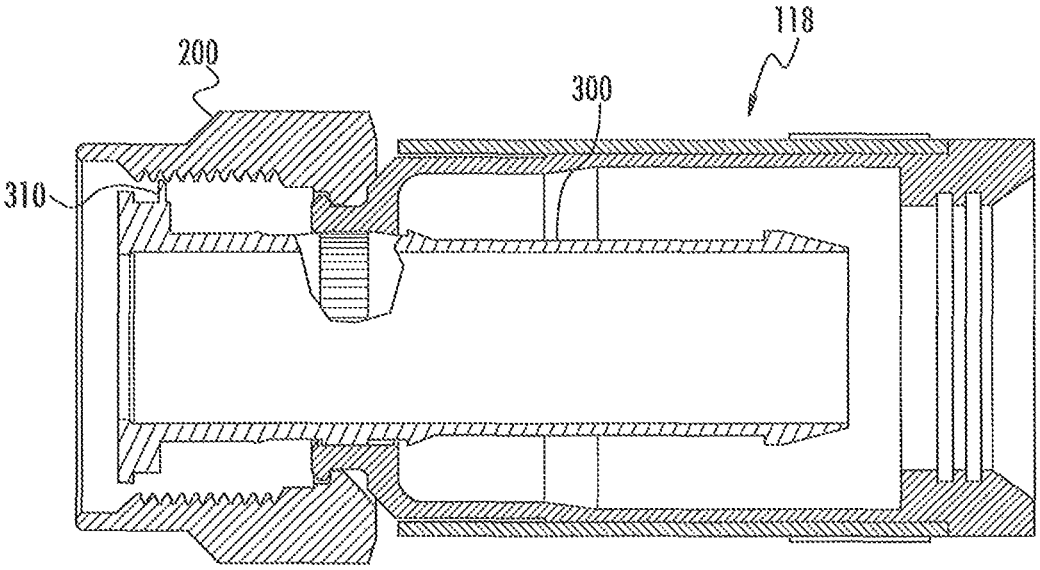
FIG. 19 is a partial, cross-sectional view of an exemplary embodiment of a coaxial cable connector having a moveable post with a contacting portion wherein the post is in a forward position.
Figure 20:
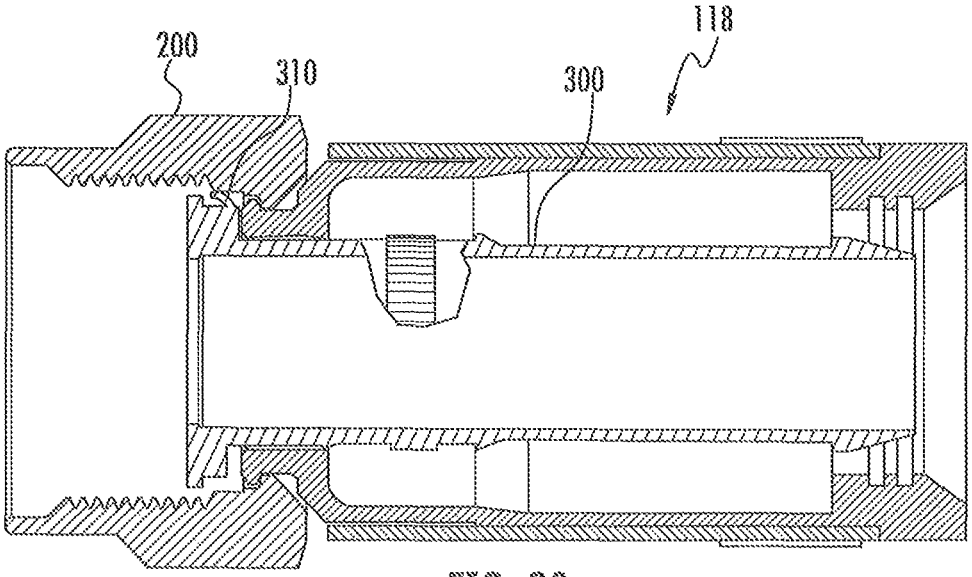
FIG. 20 is a partial cross sectional view of the coaxial cable connector of FIG. 19 with the movable post in a rearward position and the contacting portion of the movable post forming to a contour of the coupler.

FIG. 19 is a partial, cross-sectional view of an embodiment of a coaxial cable connector 118 having a post 301 comprising an integral contacting portion 310. The movable post 301 is shown in a forward position with the contacting portion 310 not formed by a contour of the coupler 200. FIG. 20 is a partial, cross-sectional view of the coaxial cable connector 118 shown in FIG. 19 with the post 301 in a rearward position and the contacting portion 310 forming to a contour of the coupler 200.

RFI shielding within given structures may be complicated when the structure or device comprises moving parts, such as a coaxial cable connector. Providing a coaxial cable connector that acts as a Faraday cage to prevent ingress and egress of RF signals can be especially challenging due to the necessary relative movement between connector components required to couple the connector to an equipment port. Relative movement of components due to mechanical clearances between the components can result in an ingress or egress path for unwanted RF signal and, further, can disrupt the electrical and mechanical communication between components necessary to provide a reliable ground path. To overcome this situation the coaxial cable connector may incorporate one or more circuitous paths that allows necessary relative movement between connector components and still inhibit ingress or egress of RF signal. This path, combined with an integral grounding flange of a component that moveably contacts a coupler acts as a rotatable or moveable Faraday cage within the limited space of a RF coaxial connector creating a connector that both shields against RFI and provides electrical ground even when improperly installed.

Figure 21:
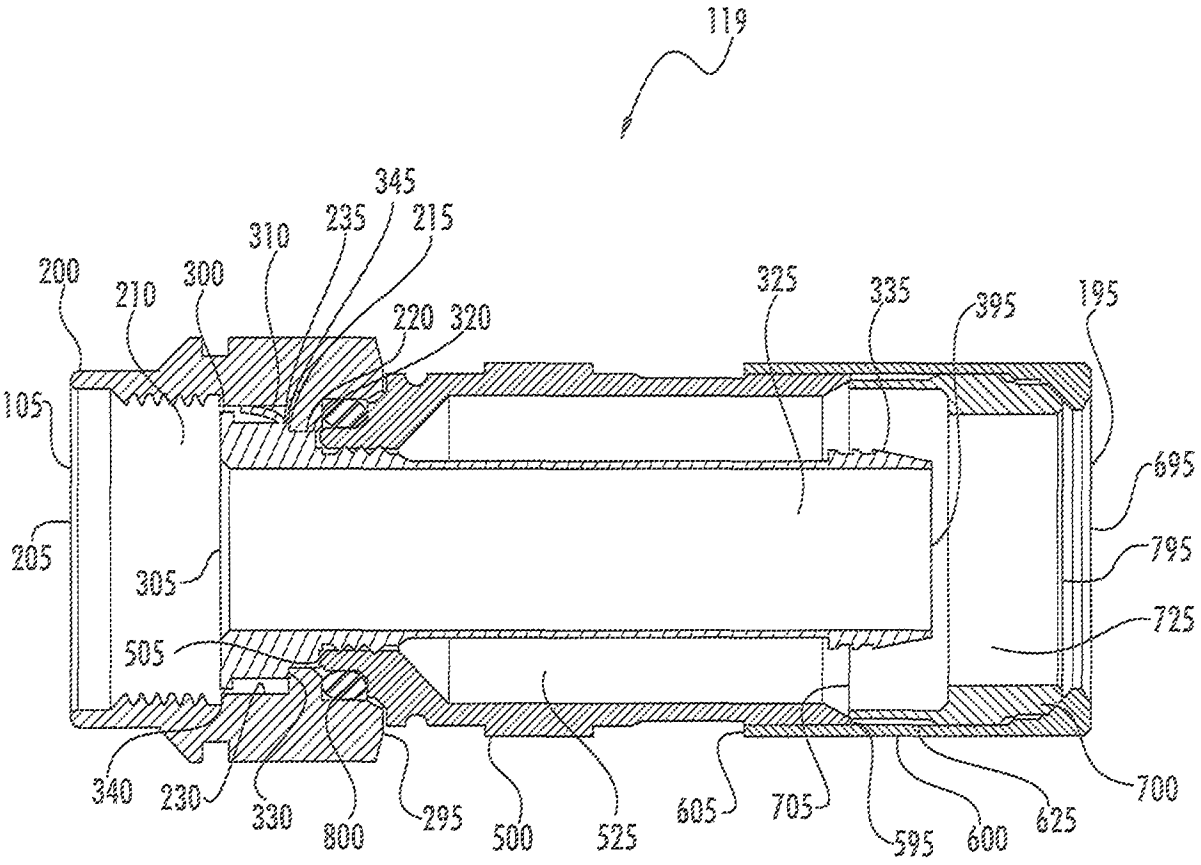
FIG. 21 is a side, cross sectional view of an exemplary embodiment of an assembled coaxial cable connector providing for circuitous electrical paths at the coupler to form an integral Faraday cage for RF protection.

In this regard, FIG. 21 illustrates a coaxial cable connector 119 having front end 105, back end 195, coupler 200, post 300, body 500, compression ring 600 and gripping member 700. Coupler 200 is adapted to couple the coaxial cable connector 119 to a terminal, which includes an equipment connection port. Body 500 is assembled with the coupler 200 and post 300. The post 300 is adapted to receive an end of a coaxial cable. Coupler 200 at least partially comprises front end 205, back end 295 central passage 210, lip 215, through-bore 220, bore 230 and bore 235. Coupler 200 is preferably made of metal such as brass and plated with a conductive material such as nickel. Post 300 at least partially comprises front end 305, back end 395, contacting portion 310, enlarged shoulder 340, collar portion 320, through-bore 325, rearward facing annular surface 330, shoulder 345 and barbed portion 335 proximate back end 395. Post 300 is preferably made of metal such as brass and plated with a conductive material such as tin. Contacting portion 310 is integral and monolithic with post 300. Contacting portion 310 provides a stable ground path and protects against the ingress and egress of RF signals. Body 500 at least partially comprises front end 505, back end 595, and central passage 525. Body 500 is preferably made of metal such as brass and plated with a conductive material such as nickel. Shell 600 at least partially comprises front end 605, back end 695, and central passage 625. Shell 600 is preferably made of metal such as brass and plated with a conductive material such as nickel. Gripping member 700 at least partially comprises front end 705, back end 795, and central passage 725. Gripping member 700 is preferably made of a polymer material such as acetal.

Although, coaxial cable connector 119 in FIG. 21 is an axial-compression type coaxial connector having post 300, contacting portion 310 may be incorporated in any type of coaxial cable connector. Coaxial cable connector 119 is shown in its unattached, uncompressed state, without a coaxial cable inserted therein. Coaxial cable connector 119 couples a prepared end of a coaxial cable to a threaded female equipment connection port (not shown in FIG. 21). Coaxial cable connector 119 has a first end 105 and a second end 195. Shell 600 slideably attaches to the coaxial cable connector 119 at back end 595 of body 500. Coupler 200 attaches to coaxial cable connector 119 at back end 295. Coupler 200 may rotatably attach to front end 305 of post 300 while engaging body 300 by means of a press-fit. Contacting portion 310 is of monolithic construction with post 300, being formed or constructed in a unitary fashion from a single piece of material with post 300. Post 300 rotatably engages central passage 210 of coupler 200 lip 215. In this way, contacting portion 310 provides an electrically conductive path between post 300, coupler 200 and body 500. This enables an electrically conductive path from the coaxial cable through the coaxial cable connector 119 to the equipment connection port providing an electrical ground and a shield against RF ingress. Elimination of separate continuity member 4000 as illustrated in connector 1000 of FIG. 1 improves DC contact resistance by eliminating mechanical and electrical interfaces between components and further improves DC contact resistance by removing a component made from a material having higher electrical resistance properties.

Figure 22:
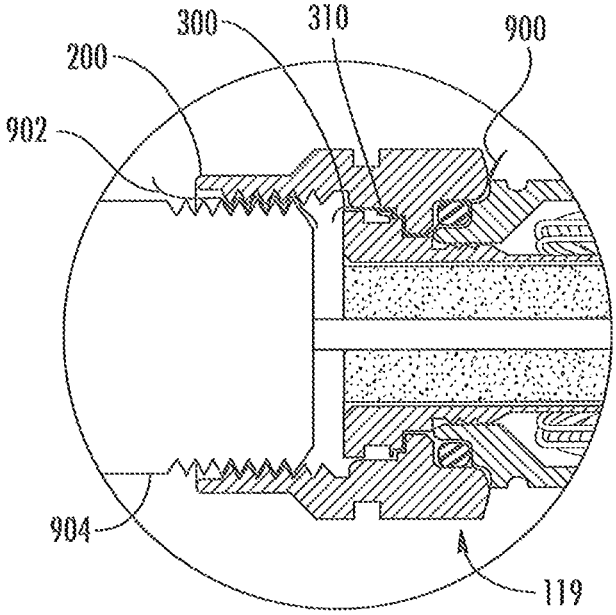
FIG. 22 is a partial, cross-sectional detail view of the assembled coaxial cable connector of FIG. 21 illustrating a circuitous path between the coupler, post and body another circuitous path between the coupler and the equipment connection port.
Figure 23:
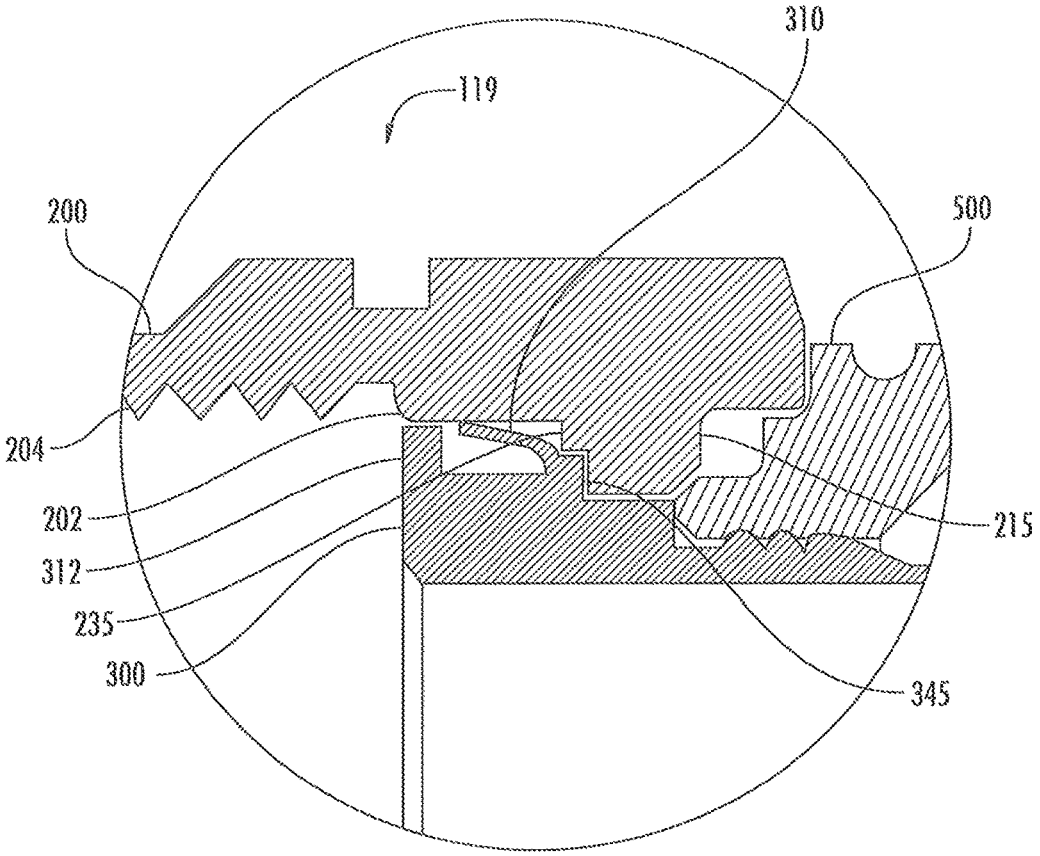
FIG. 23 is a partial, cross sectional detail view of the coupler, the post and the body of FIG. 22.

An enlarged shoulder 340 at front end 305 extends inside coupler 200. Enlarged shoulder 340 comprises flange 312, contacting portion 310, collar portion 320, rearward facing annular surface 330 and shoulder 345. Collar portion 320 allows coupler 200 to rotate by means of a clearance fit with through bore 220 of coupler 200. Rearward facing annular surface 330 limits forward axial movement of coupler 200 by engaging lip 215. Contacting portion 310 contacts coupler 200 forward of lip 215. Contacting portion 310 may be formed to contactedly fit with the coupler 200 by utilizing coupler 200 to form contacting portion 310 upon assembly of coaxial cable connector 119 components. In this manner, contacting portion 310 is secured within coaxial cable connector 119, and establishes mechanical and electrical contact with coupler 200 and, thereby, an electrically conductive path between post 300 and coupler 200. Further, contacting portion 310 remains contactedly fit, in other words in mechanical and electrical contact, with coupler 200 regardless of the tightness of coaxial cable connector 119 on the appliance equipment connection port. In this manner, contacting portion 310 is integral to the electrically conductive path established between post 300 and coupler 200 even when the coaxial cable connector 119 is loosened and/or disconnected from the appliance equipment connection port. Post 300 has a front end 305 and a back end 395. Back end 395 is adapted to extend into a coaxial cable. Proximate back end 395, post 300 has a barbed portion 335 extending radially outwardly from the tubular post 300. With reference to FIG. 22, there are shown two paths 900, 902, which depict potential RF leakage paths. Coaxial cable connector 119 includes structures to increase the attenuation of RF ingress or egress via paths 900, 902. RF leakage may occur via path 900 through coupler 200 back end 295 at the body 500 and between the lip 215 and post 300. However, as shown in FIG. 23, step 235 and shoulder 345, along with contacting portion 310 and flange 312 form a circuitous path along path 900. The structure of the coupler 200 and post 300 closes off or substantially reduces a potential RF leakage path along path 900, thereby increasing the attenuation of RF ingress or egress signals. In this way, coupler 200 and post 500 provide RF shielding such that RF signals external to the coaxial cable connector 119 are attenuated such that the integrity of an electrical signal transmitted through coaxial cable connector 119 is maintained regardless of the tightness of the coupling of the connector to equipment connection port 904.

With reference again to FIG. 22, RF leakage via path 902 may be possible along threaded portion of coupler 200 to equipment connection port 904. This is particularly true when the coaxial cable connector 119 is in a dynamic condition such as during vibration or other type of externally induced motion. Under these conditions electrical ground can be lost and an RF ingress path opened when the threads 204 of the coupler 200 and the threads 906 of the equipment connection port 904 become coaxially aligned reducing or eliminating physical contact between the coupler 200 and the equipment connection port 904. By modifying the form of the coupler 200 threads 204 the tendency of the coupler 200 to equipment connection port 904 to lose ground contact and open an RF ingress path via path 902 is mitigated, thereby increasing the attenuation of RF ingress or egress signals.

Figure 24:
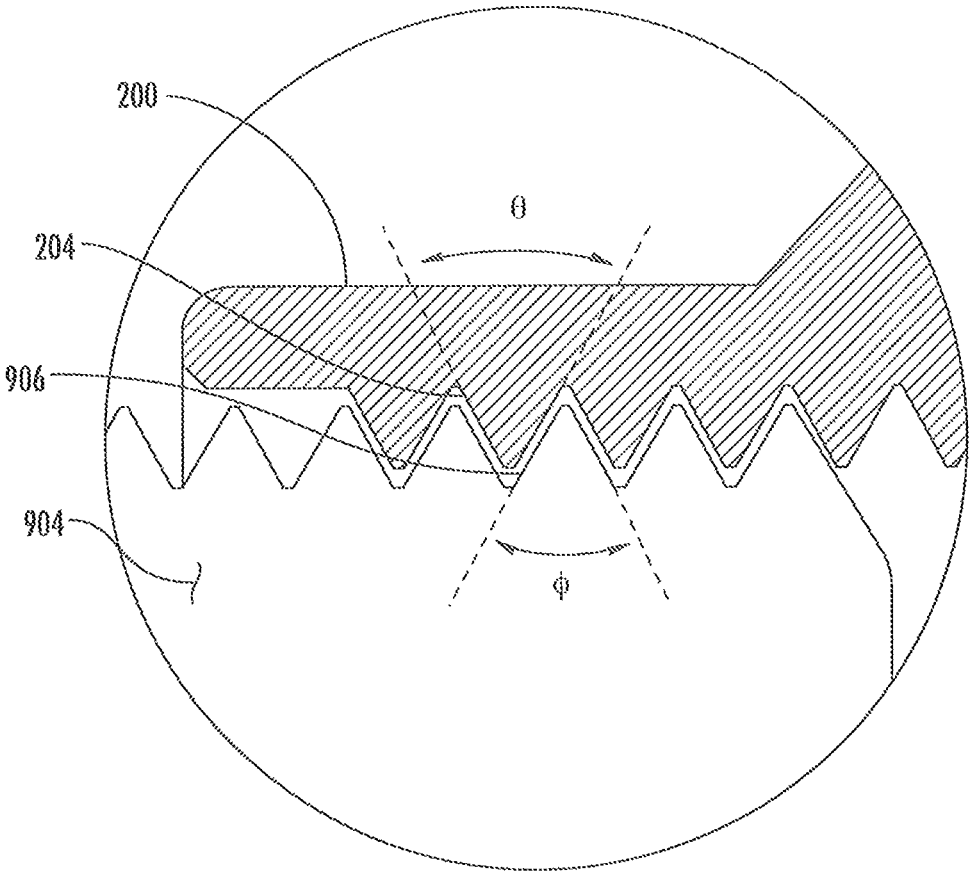
FIG. 24 is a partial, cross-sectional detail view of the threads of an equipment connection port and the threads of the coupler of the assembled coaxial cable connector of FIG. 22.

The structure of the threads 204 of the coupler 200 may involve aspects including, but are not limited to, pitch diameter of the thread, major diameter of the thread, minor diameter of the thread, thread pitch angle "θ", thread pitch depth, and thread crest width and thread root radii. Typically, the pitch angle "θ" of thread 204 of coupler 200 is designed to match, as much as possible, the pitch angle "ϕ" of thread 906 of equipment connection port 904. As shown in FIG. 24, pitch angle "θ" may be different than pitch angle "ϕ" to reduce interfacial gap between thread 204 of coupler 200 and thread 906 of equipment connection port 904. In this way, the threaded portion of the coupler 200 traverses a shorter distance before contacting the threaded portion of the equipment connection port 904 closing off or substantially reducing a potential RF leakage path along path 902. Typically, thread 906 angle "ϕ" of the equipment connection port 904 is set at 60 degrees. As a non-limiting example, instead of designing coupler 200 with threads 204 of angle "θ", angle "θ" may be set at about 62 degrees which may provide the reduced interfacial gap as discussed above. In this way, coupler 200 and post 500 provide RF shielding such that RF signals external to the coaxial cable connector 119 are attenuated such that the integrity of an electrical signal transmitted through coaxial cable connector 119 is maintained regardless of the tightness of the coupling of the connector to equipment connection port 904.

Typically, RF signal leakage is measured by the amount of signal loss expressed in decibel ("dB"). Therefore, "dB" relates to how effectively RF shielding is attenuating RF signals. In this manner, RF signal ingress into a coaxial cable connector 119 or egress out from a coaxial cable connector 119 may be determined, and, thereby, the ability of the RF shielding of a coaxial cable connector 119 to attenuate RF signals external to the coaxial cable connector 119. Accordingly, the lower the value of "dB" the more effective the attenuation. As an example, a measurement RF shielding of −20 dB would indicate that the RF shield attenuates the RF signal by 20 dB as compared at the transmission source. For purposes herein, RF signals external to the coaxial cable connector 119 include either or both of RF signal ingress into a coaxial cable connector 119 or egress out from a coaxial cable connector 119.

Figure 25:
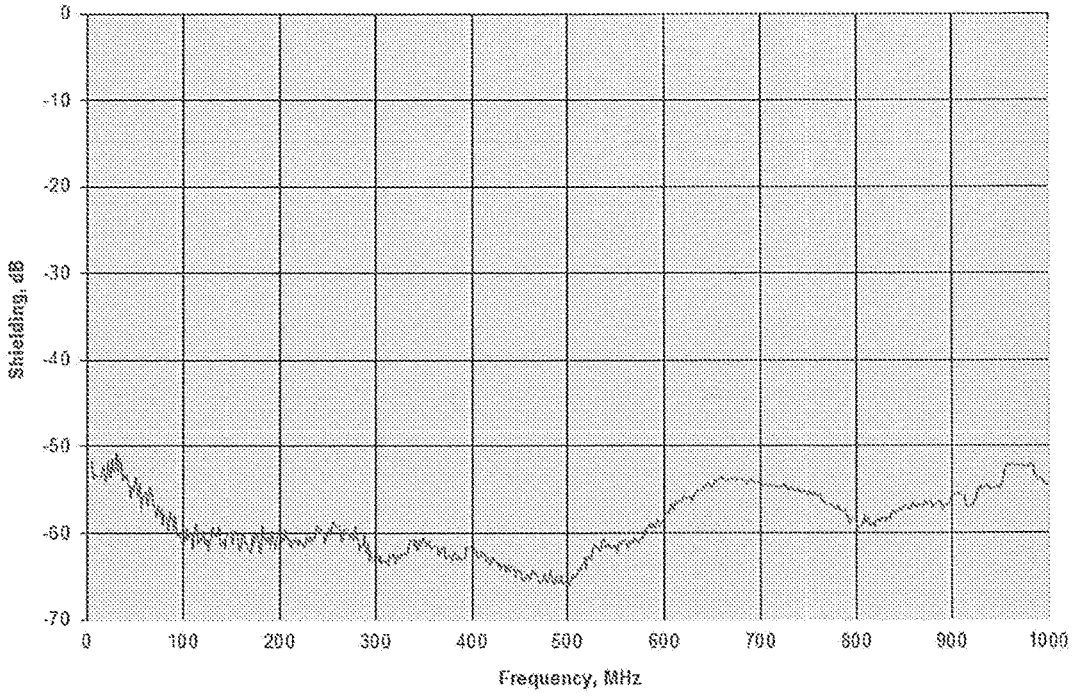
FIG. 25 is a graphic representation of the RF shielding of the coaxial cable connector in FIG. 21 in which the RF shielding is measured in dB over a range of frequency in MHz.

Referring now to FIG. 25, illustrates comparative RF shielding effectiveness in "dB" of coaxial cable connector 119 over a range of 0-1000 megahertz ("MHz"). The coupling 200 was finger tightened on the equipment connection port 904 and then loosened two full turns. As illustrated in FIG. 25, the RF shielding in "dB" for coaxial cable connector 119 for all frequencies tested indicated that the RF signal was attenuated by more than 50 dB.

Additionally, the effectiveness of RF signal shielding may be determined by measuring transfer impedance of the coaxial cable connector. Transfer impedance is the ratio of the longitudinal voltage developed on the secondary side of a RF shield to the current flowing in the RF shield. If the shielding effectiveness of a point leakage source is known, the equivalent transfer impedance value can be calculated using the following calculation:

$$SE=20 \log Z_{total}-45.76 \text{ (dB)}$$

Accordingly, using this calculation the average equivalent transfer impedance of the coaxial cable connector 119 is about 0.24 ohms.

As discussed above, electrical continuity shall mean DC contact resistance from the outer conductor of the coaxial cable to the equipment port of less than about 3000 milliohms. In addition to increasing the attenuation of RF signals by closing off or reducing the RF leakage via paths 900, 902, the DC contact resistance may be substantially reduced. As a non-limiting example, the DC contact resistance may be less than about 100 milliohms, and preferably less than 50 milliohms, and more preferably less than 30 milliohms, and still more preferably less than 10 milliohms.

It should be understood that while the invention has been described in detail with respect to various exemplary embodiments thereof, it should not be considered limited to such, as numerous modifications are possible without departing from the broad scope of the appended claims. It is intended that the embodiments cover the modifications and variations of the embodiments provided they come within the scope of the appended claims and their equivalents. Although specific terms are employed herein, they are used in a generic and descriptive sense only and not for purposes of limitation.

What is claimed is:

1. A coaxial cable connector for coupling an end of a coaxial cable to a terminal, the coaxial cable comprising an inner conductor, a dielectric surrounding the inner conductor, an outer conductor surrounding the dielectric, and a jacket surrounding the outer conductor, the connector comprising:

a coupler configured to couple the connector to the terminal, the coupler comprising a front end, a rear end, a surface defining an inner bore disposed between the front end and the rear end of the coupler, and a lip extending inwardly into the inner bore of the coupler at a rear end of the coupler to define a forward facing surface of the lip;

a body assembled with the coupler, the body comprising a forward portion, a forward facing annular surface that limits the rearward axial movement of the coupler, and a rearward portion, the forward portion extending into the inner bore of the coupler and expanding radially outward in the inner bore of the coupler forward of the lip of the coupler to define a rearward facing annular surface opposing the forward facing surface of the lip of the coupler to limit forward axial movement of the coupler;

a post assembled with the coupler and the body, the post comprising a front end extending into the inner bore of the coupler through the rear end of the coupler, a rear end configured to receive the end of the coaxial cable connector, a flange at the front end of the post, an enlarged shoulder between the flange and the rear end of the post, and a contacting portion that is integral and monolithic with the post and extends from the enlarged shoulder into the inner bore of the coupler into contact with the surface defining the inner bore of the coupler;

wherein the forward facing annular surface of the body comprises a vertical portion expanding radially outward from a middle portion of the body, and a diagonal portion expanding radially outward and rearward from the vertical portion of the forward facing annular surface of the rearward portion of the body.

2. The coaxial cable connector of claim 1, wherein:

the forward portion of the body further comprises a forward facing surface, the enlarged shoulder of the post defines a rearward facing annular surface of the post, and the forward facing surface of the forward portion of the body contacts the rearward facing annular surface of the post with the post in a rearward position.

3. The coaxial cable connector of claim 1, wherein RF signals external to the coaxial cable connector are attenuated by at least about 50 dB in a range up to about 1000 MHz.

4. The coaxial cable connector of claim 3, wherein the RF signals external to the connector comprise RF signals that ingress into the connector.

5. The coaxial cable connector of claim 3, wherein the RF signals external to the connector comprise RF signals that egress out from the connector.

6. The coaxial cable connector of claim 1, wherein a transfer impedance measured from the outer conductor of the coaxial cable to the terminal through the connector averages less than about 0.24 ohms.

7. The coaxial cable connector of claim 1, wherein a first circuitous path includes a plurality of pairs of electromagnetically coupled faces established by at least one of the lip, the flange, the contacting portion, and the enlarged shoulder, and wherein the first circuitous path attenuates of RF signals external to the connector.

8. The coaxial cable connector of claim 1, wherein the terminal comprises an equipment connection port, and wherein the coupler comprises a threaded portion configured to connect with a threaded portion of an equipment connection port, and wherein at least one thread of the coupler has a pitch angle different than a pitch angle of at least one thread of the equipment connection port.

9. The coaxial cable connector of claim 8, wherein the pitch angle of the thread of the coupler is about 2 degrees different than the pitch angle of the thread of the equipment connection port.

10. The coaxial cable connector of claim 8, wherein the pitch angle of the thread of the coupler is about 62 degrees, and the pitch angle of the thread of the equipment connection port is about 60 degrees.

11. The coaxial cable connector of claim 8, wherein the threaded portion of the coupler and the threaded portion of the equipment connection port, establish a second circuitous path that attenuates RF signals external to the connector.

* * * * *